US009662878B2

(12) United States Patent
Yamauchi et al.

(10) Patent No.: US 9,662,878 B2
(45) Date of Patent: May 30, 2017

(54) INK JET RECORDING APPARATUS AND INK JET RECORDING METHOD

(71) Applicant: CANON KABUSHIKI KAISHA, Tokyo (JP)

(72) Inventors: Kazunori Yamauchi, Yokohama (JP); Masashi Hayashi, Yokohama (JP); Daisuke Kobayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/827,114

(22) Filed: Aug. 14, 2015

(65) Prior Publication Data

US 2016/0052265 A1 Feb. 25, 2016

(30) Foreign Application Priority Data

Aug. 20, 2014 (JP) ..... 2014-167558

(51) Int. Cl.
*B41J 2/045* (2006.01)
*B41J 13/00* (2006.01)

(52) U.S. Cl.
CPC ..... *B41J 2/04563* (2013.01); *B41J 2/04528* (2013.01); *B41J 2/04586* (2013.01); *B41J 13/0009* (2013.01); *B41J 13/0018* (2013.01)

(58) Field of Classification Search
CPC B41J 2/04563; B41J 2/04528; B41J 2/04586; B41J 13/0009; B41J 13/0018
See application file for complete search history.

(56) References Cited

U.S. PATENT DOCUMENTS

| | | | | |
|---|---|---|---|---|
| 6,193,344 | B1 * | 2/2001 | Otsuka | B41J 2/04528 347/10 |
| 6,341,909 | B1 | 1/2002 | Fukui | |
| 2005/0270322 | A1 | 12/2005 | Uji et al. | |
| 2006/0066655 | A1 | 3/2006 | Richard | |
| 2006/0187287 | A1 | 8/2006 | Edwards | |
| 2007/0247651 | A1 * | 10/2007 | Maehira | H04N 1/0057 358/1.12 |

FOREIGN PATENT DOCUMENTS

| | | | |
|---|---|---|---|
| JP | H04-097856 | A | 3/1992 |
| JP | 2000-015881 | A | 1/2000 |
| JP | 2002-068500 | A | 3/2002 |
| JP | 2008-188987 | A | 8/2008 |

* cited by examiner

*Primary Examiner* — Stephen Meier
*Assistant Examiner* — Alexander D Shenderov
(74) *Attorney, Agent, or Firm* — Canon USA, Inc. I.P. Division

(57) ABSTRACT

Heating is stopped in between recordings in a first recording mode where the time between recordings is relatively long, while heating is continuously performed in between recordings in a second recording mode where the time between recordings is relatively short.

8 Claims, 17 Drawing Sheets

INK JET RECORDING APPARATUS AND INK JET RECORDING METHOD

BACKGROUND OF THE INVENTION

Field of the Invention

The present invention relates to an ink jet recording apparatus and an ink jet recording method.

Description of the Related Art

There have been known ink jet recording apparatuses in which a recording head, having multiple recording elements that discharge ink, is scanned over a recording medium while the recording elements are driven, thereby discharging ink upon the recording medium to record an image. It is known that such ink jet recording apparatuses may encounter trouble such as decrease in amount of discharge or discharge failure if the temperature of the ink being discharged is low. This phenomenon results in insufficient quality of the image being recorded. There is also known a technique where the recording head is heated if the temperature of the recording head is lower than a predetermined target temperature before starting or during recording, but not heated to where the heating would cause ink to be discharged. Thus, temperature-retention control can be performed to where the temperature of the recording head is within a predetermined range.

If the temperature of the recording head is lower than the target temperature when starting recording, heating needs to be performed until the temperature of the recording head reaches the target temperature, before starting recording. This results in heating waiting time, meaning that the throughput of recording suffers. Japanese Patent Laid-Open No. 2008-188987 discloses a method to suppress reduced recording throughput by starting heating in a non-recording period before starting recording on a certain recording medium, and stopping the heating when recording on the recording medium ends.

However, according to Japanese Patent Laid-Open No. 2008-188987, temperature-retention control is not performed after recording on one certain recording medium ends until recording starts on the next recording medium. While power consumption can be suppressed by temporarily stopping electric power, the temperature of the recording head will drop each time a recording medium is recorded on. Once such a temperature drop occurs, the temperature of the recording head cannot be raised to the target temperature in a short time before recording on the next recording medium, so there is the concern that waiting time for heating of the recording head may occur. Also, in a case of recording on both faces of a recording medium, the same problem of heating waiting time may occur between recording on the faces, even if the amount of time between ending recording on the front face of the recording medium and starting recording on the rear face of the recording medium is set to a short time. Such occurrence of heating waiting time may result in lower recording throughput when consecutively recording on multiple recording mediums in a short time, or when performing double-side recording.

On the other hand, even when consecutively recording on multiple recording mediums, if the interval from recording on a certain recording medium till recording on the next recording medium is long, sufficient time can be taken to perform temperature-retention control till the recording on the next recording medium starts. Accordingly, there may be cases where, even though the power is temporarily turned off, the power can be turned on again and the temperature of the recording head can be raised to the target temperature or higher in time to record the next recording medium.

SUMMARY OF THE INVENTION

It has been found desirable to perform temperature-retention control that realizes both suppression in decrease of recording throughput and suppressed power consumption.

An ink jet recording apparatus, includes: a recording head configured to discharge ink; an acquisition unit configured to acquire information relating to temperature of the recording head; a conveying unit configured to convey a recording medium; a heating control unit configured to heat the recording head so that the temperature of the recording head is a target temperature, based on information relating to the temperature of the recording head acquired by the acquiring unit; a selecting unit configured to select one recording mode to execute, from a plurality of recording modes including at least a first recording mode where a first recording medium and a second recording medium are conveyed by the conveying unit such that, during recording of the first recording medium which is recorded upon first, the first recording medium and the second recording medium which is recorded upon next after the first recording medium do not overlap, a second recording mode where the first recording medium and the second recording medium are conveyed by the conveying unit such that, during recording of the first recording medium, an edge of the first recording medium at the upstream side in the conveyance direction and an edge of the second recording medium at the downstream side in the conveyance direction are overlapped; and a recording unit configured to performing recording by the recording head in accordance with the recording mode selected by the selecting unit. The heating control unit (i) temporarily stops heating of the recording head during a period from ending of recording onto the first recording medium till starting of recording on the second recording medium in a case where the selecting unit selects the first recording mode, and (ii) heats the recording head so as to maintain the target temperature, during the period from ending of recording onto the first recording medium till starting of recording on the second recording medium, in a case where the selecting unit selects the second recording mode.

Further features of the present invention will become apparent from the following description of exemplary embodiments with reference to the attached drawings.

DESCRIPTION OF THE EMBODIMENTS

An embodiment of the present invention will be described below with reference to the drawings.

Figure 1A:
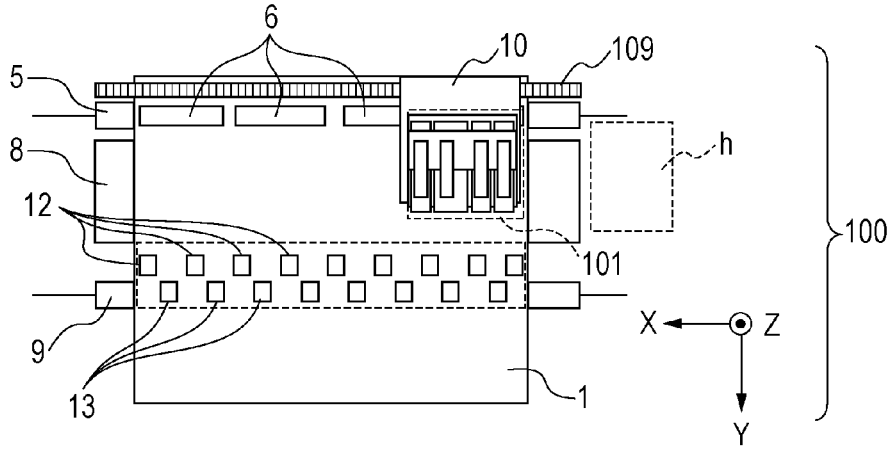
FIGS. 1A and 1B are perspective views of an ink jet recording apparatus according to an embodiment.
Figure 1B:
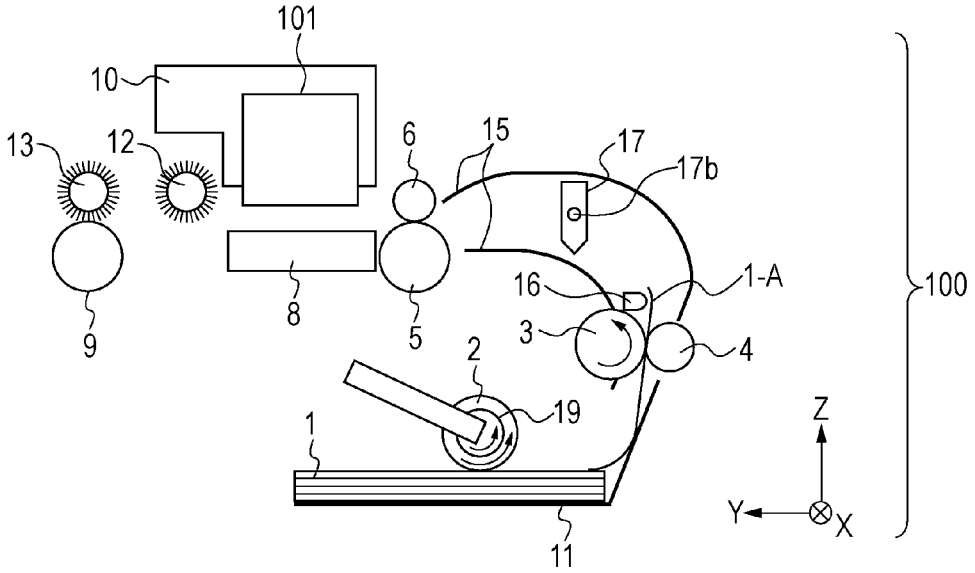

FIG. 1A is a schematic diagram illustrating a top view inside of an ink jet recording apparatus (hereinafter "recording apparatus") 100 according to the present embodiment. FIG. 1B is a cross-sectional view of inside the recording apparatus 100, taken along a Y-Z plane.

Multiple sheets of a recording medium 1 are loaded on a feeding tray 11 (loading unit). A pickup roller 2 abuts the topmost recording medium 1 loaded on the feeding tray 11, and picks up this recording medium 1. A feeding roller 3 feeds the recording medium 1 picked up by the pickup roller 2 downstream in the Y direction (conveyance direction). A feeding follower roller 4 nips and feeds the recording medium 1 along with the feeding roller 3 against which it is biased.

A conveyance roller 5 conveys the recording medium 1 fed by the feeding roller 3 and feeding follower roller 4 to a position facing a recording head 101. A pinch roller 6 nips and feeds the recording medium 1 along with the conveyance roller 5 against which it is biased.

The recording head 101 discharges ink to perform recording to the recording medium 1 conveyed by the conveyance roller 5 and pinch roller 6. A platen 8 supports the rear face of the recording medium 1 at the position facing the recording head 101. A carriage 10 mounts and scans the recording head 101 in the X direction (scanning direction).

A discharge roller 9 discharges the recording medium 1 which has been recorded on by the recording head 101 to the outside of the apparatus. Spurs 12 and 13 rotate in contact with the recorded face of the recording medium where recording has been performed by the recording head 101. The spur 13 which is on the downstream side in the Y direction is biased against the discharge roller 9, while the spur 12 which is on the upstream side has no the discharge roller 9 disposed at a facing position. The spur 12 is to prevent the recording medium 1 from floating upwards, and is also referred to as a pressing spur.

The recording medium 1 is guided between the feeding nip formed by the feeding roller 3 and feeding follower roller 4, and the conveyance nip formed by the conveyance roller 5 and pinch roller 6, by a conveyance guide 15. A recording medium detecting sensor 16 is disposed downstream of the feeding roller 3 in the Y direction, to detect the leading edge and trailing edge of the recording medium 1. A recording medium pressing lever 17 is for overlapping the leading edge portion of a following recording medium on the trailing edge portion of a preceding recording medium in the later-described overlapped tandem feed recording mode, being biased in the counterclockwise direction in the illustration by a spring on a rotating shaft 17*b*.

Figure 2A:
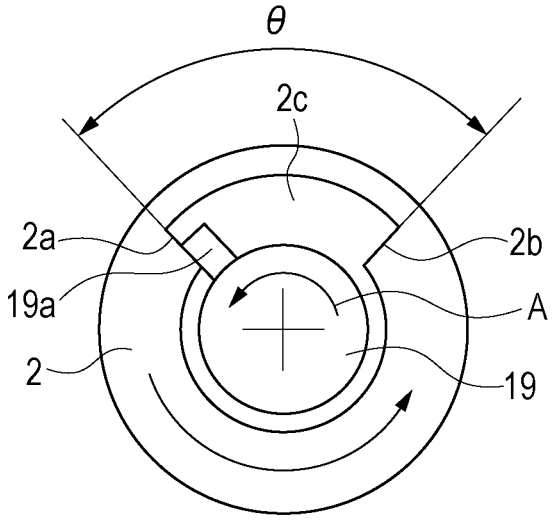
FIGS. 2A and 2B are schematic diagrams illustrating the configuration of a pickup roller according to an embodiment.
Figure 2B:
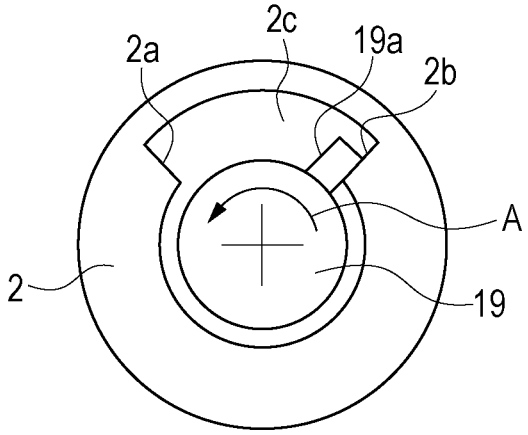

FIGS. 2A and 2B are drawings for describing the configuration of the pickup roller 2. As described above, the pickup roller 2 abuts the topmost recording medium 1 loaded on the feeding tray 11 and picks up this recording medium 1. A driving shaft 19 transmits the driving of a later-described feeding motor to the pickup roller 2. When picking up the recording medium 1, the driving shaft 19 and pickup roller 2 rotate in the direction indicated by the arrow A in FIGS. 2A and 2B. The driving shaft 19 is provided with a protrusion 19*a*. A recessed portion 2*c* where the protrusion 19*a* fits is formed on the pickup roller 2. In a case where the protrusion 19*a* is abutting a first face 2*a* of the recessed portion 2*c* of the pickup roller 2 as illustrated in FIG. 2A, the driving of the driving shaft 19 is transmitted to the pickup roller 2, and the pickup roller 2 is rotated by the driving of the driving shaft 19. On the other hand, in a case where the protrusion 19*a* abuts a second face 2*b* of the recessed portion 2*c* of the pickup roller 2 as illustrated in FIG. 2B, the driving of the driving shaft 19 is not transmitted to the pickup roller 2, and the pickup roller 2 is not rotated by the driving of the driving shaft 19. In a case where the protrusion 19*a* is abutting neither the first face 2*a* nor the second face 2*b* but is between the first face 2*a* and second face 2*b*, driving the driving shaft 19 does not rotate the pickup roller 2.

Figure 3:
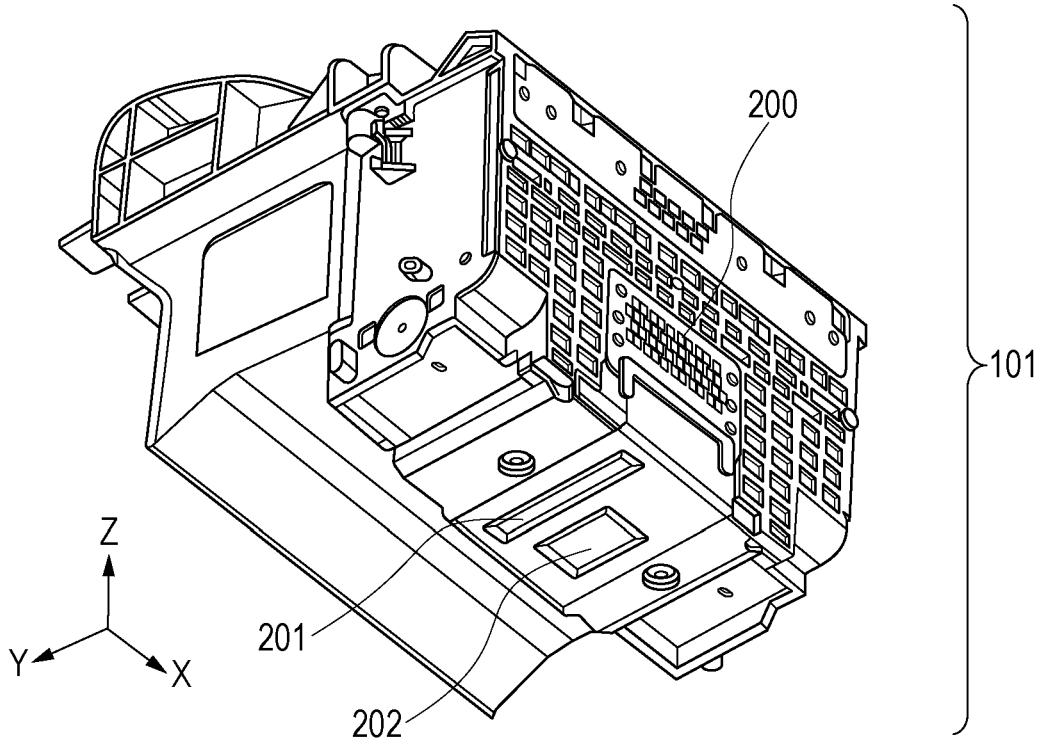
FIG. 3 is a perspective view of a recording head according to an embodiment.
Figure 4A:
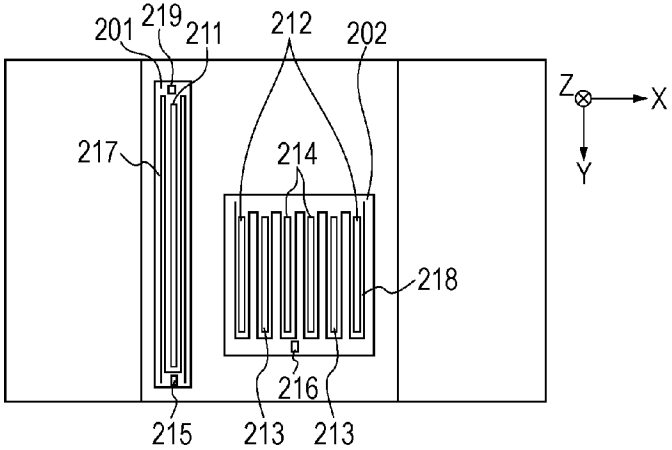
FIGS. 4A through 4C are enlarged diagrams of a recording head according to an embodiment.
Figure 4B:
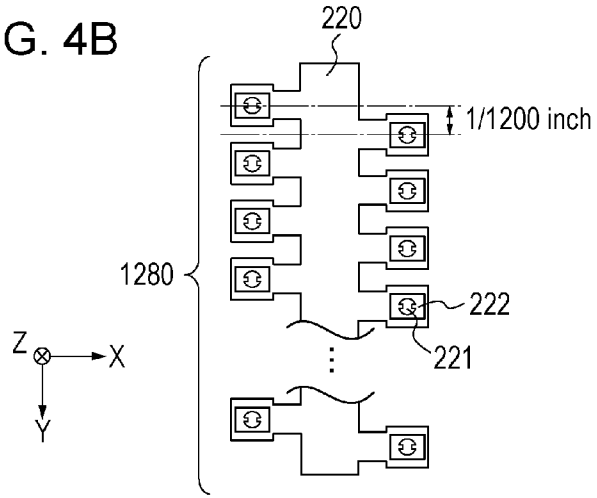
Figure 4C:
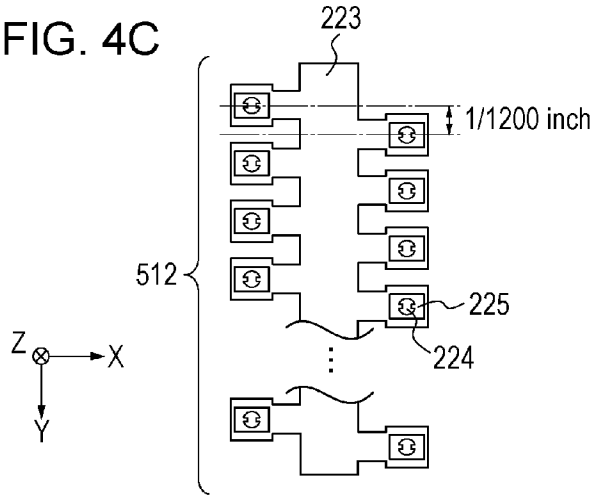

FIG. 3 is a schematic perspective view illustrating the configuration of the recording head 101 according to the present embodiment. FIGS. 4A through 4C are enlarged drawings illustrating chips (recording element boards) 201 and 202 upon which are provided discharge orifice arrays of the recording head according to the present embodiment. FIG. 4A is a bottom face view of the recording head 101 from the Z direction. FIG. 4B is an enlarged direction of a discharge orifice array 211 provided to a black ink recording chip 201 of the recording head 101. FIG. 4C is an enlarged direction of discharge orifice arrays 212, 213, and 214 provided to a color ink recording chip 202 of the recording head 101.

The recording head 101 receives recording signals from the recording apparatus main body via contact pads 200, and electric power necessary for driving the recording head is supplied. A black discharge orifice array 211 is disposed on a black ink recording chip (hereinafter "black chip") 201. A cyan discharge orifice array 212 that discharges cyan ink, a magenta discharge orifice array 213 that discharges magenta ink, and a yellow discharge orifice array 214 that discharges yellow ink, are disposed on a color ink recording chip (hereinafter "color chip") 202. The black chip 201 and the color chip 202 each are provided with diode sensors 215, 216, and 219, corresponding to temperature detecting elements of the recording head 101. The black chip 201 and the color chip 202 each are also provided with sub-heaters 217 and 218 for heating ink, which are configured including 340Ω resistors.

FIG. 4C is an enlarged view of the discharge orifice array 211 for discharging black ink. Discharge orifices 221 for discharging ink are arrayed on both sides of an ink chamber 220. A discharging heater 222 is disposed at each position corresponding to each discharge orifice 221. The discharging heaters 222 each generate heat which is subjected to driving voltage, causing bubbling of the ink on the discharging heater 222, thus discharging ink from each discharge orifice 221. The amount of black ink discharged from one discharge orifice is 12 ng. The number of discharge orifices 221 is 1280, and the intervals between the discharge orifices 221 is 1/1200 inches. Accordingly, the recording head according to the present embodiment is configured so that the recording pixel density is 1200 dpi. The length of the discharge orifice array in the Y direction is 1280×(1/1200 inch)=1.07 inches.

FIG. 4C is a diagram for describing discharge orifice arrays 212, 213, and 214 that discharge color ink. While an enlarged view of one cyan discharge orifice array 212 is exemplarily illustrated here, the configuration is the same in the other cyan discharge orifice array 212, two magenta discharge orifice arrays 213, and two yellow discharge orifice arrays 214, as well.

Discharge orifice arrays that discharge ink of the various colors are disposed on both sides of an ink chamber 223. A discharging heater 225 is disposed at each position corresponding to each discharge orifice 224. The heaters 225 each generate heat which subjected to driving voltage, causing bubbling of the ink on the discharging heater 225, thus discharging ink from each discharge orifice 224. The amount of color ink discharged from one discharge orifice 224 is 6 ng. The number of discharge orifices 224 is 512, and the intervals between the discharge orifices 224 is 1/1200 inches. Accordingly, the recording head according to the present embodiment is configured so that the recording pixel density is 1200 dpi. The length of the discharge orifice array in the Y direction is 512×(1/1200 inch)=0.43 inches.

Note that the resistance value of the heaters 225 is larger than the resistance value of the black ink discharging heaters 222. Accordingly, the heaters 225 generate less heat than the heaters 222. The reason is that the amount of color ink discharged is less than the amount of black ink discharged, so the amount of energy necessary to discharge the color ink is smaller than the amount of energy necessary to discharge the black ink. At the same time, the amount of temperature rise due to discharging color ink from one discharge orifice is smaller than the amount of temperature rise due to discharging black ink from one discharge orifice.

The recording apparatus according to the present embodiment is capable of executing two types of temperature retention control; sub-heater heating using the sub-heaters 217 and 218 for heating the recording head and ink, and short-pulse heating using the heaters 222 and 225.

Heating of the recording head is indirectly performed by applying voltage of 32 V to the sub-heaters 217 and 218 in the sub-heater control according to the present embodiment.

Also, short pulses (driving pulses) of a level to not cause ink to be discharged is applied to the heaters 222 and 225 in the short pulse heating control according to the present embodiment, and the recording head is heated by driving the heaters 222 and 225.

In the short-pulse heating control and sub-heater heating control according to the present embodiment, the amount of thermal energy per time unit (heating capability) is greater when performed by short-pulse heating control. Accordingly, the temperature of the recording head can be raised in a shorter amount of time by the short-pulse heating control. On the other hand, when executing recording, the heaters 222 and 225 are being used for discharging and accordingly cannot be used for short-pulse heating control. In light of the above, in the present embodiment sub-heater heating control is performed in a case of performing temperature-retention control while recording, and short-pulse heating control in a case of performing temperature-retention control when not recording.

At the time of the short-pulse heating control and sub-heater heating control, feedback control is performed in which heating/non-heating of the recording chips is switched based on temperature information detected by the diode sensors 215, 216, and 219, so as to approach an adjustment temperature.

Now, the scanning speed of the carriage mounting the recording head 101 in the X direction is 24000 (dots per second)/600 (dots per inch)=40 inches per second in a case of recording ink droplets at 600 dpi intervals in the X direction.

Figure 5:
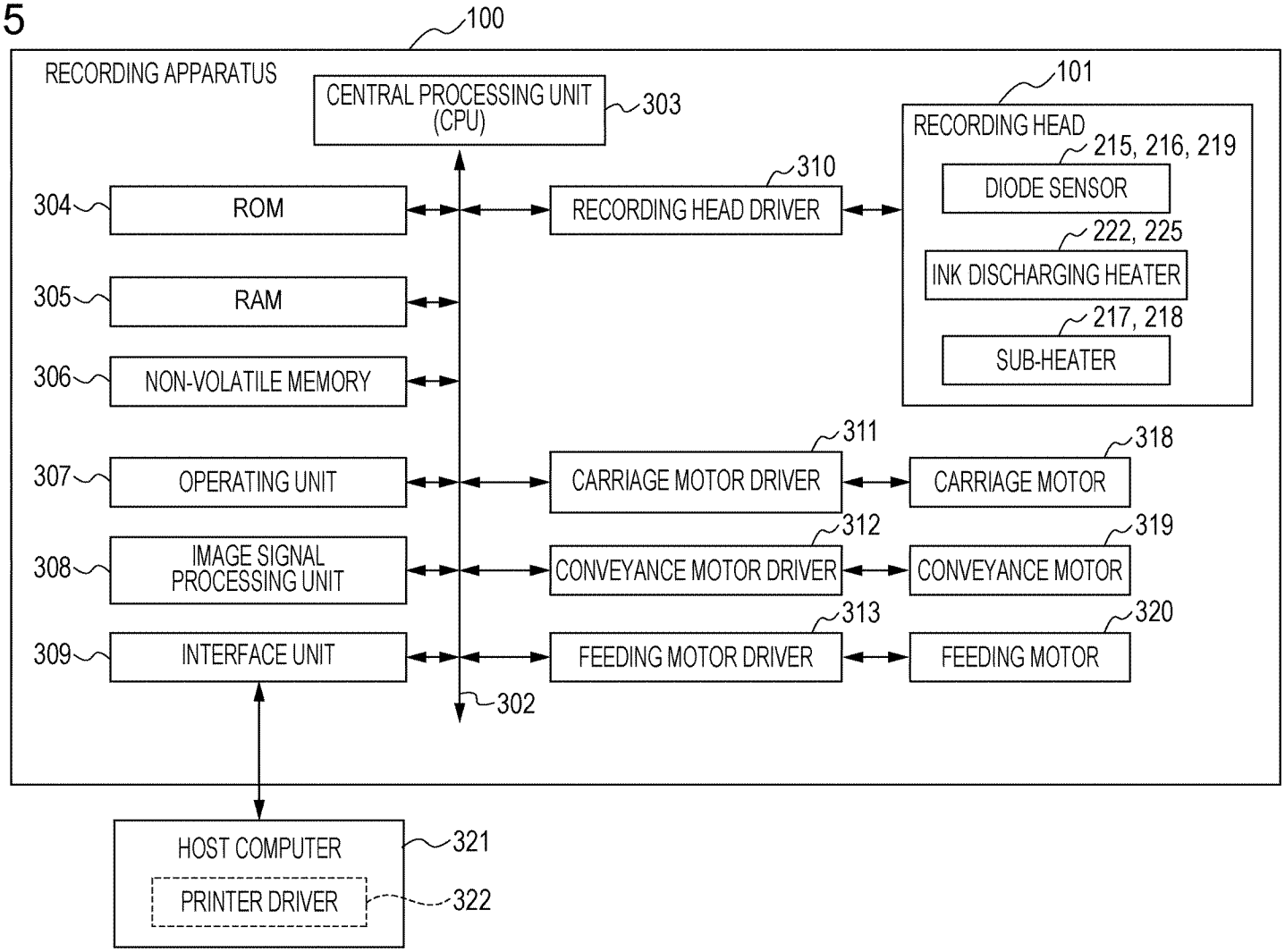
FIG. 5 is a diagram for describing a recording control system according to an embodiment.

FIG. 5 is a block diagram illustrating a schematic configuration of a recording control system according to the present embodiment. A central processing unit (CPU) 303 is a system control unit that controls the entire recording apparatus 100. Read-only memory (ROM) 304 stores control programs and an embedded operating system (OS) program and so forth that the CPU 303 executes. The control programs stored in the ROM 304 in the present embodiment perform software control such as scheduling and task switching and so forth, under control of the embedded OS stored in the ROM 304. Random access memory (RAM) 305 is configured including static RAM (SRAM) or the like, and is used to store program control variables and the like, to store setting values registered by the user, management data of the recording apparatus 100, and so forth, and also as a buffer region for various types of work. Non-volatile memory 306 is configured including flash memory or the like, and stores data which is desired to be saved even after the power is turned off. Examples of this include registration adjustment values, information of a host computer 321 to which connection had been made in the past, and so forth. An operating unit 307 is configured including keys such as a power key, stop key and so forth, and a touch panel, and accepts user operations.

As illustrated in FIGS. 3 through 4B, the recording head 101 includes diode sensors 215, 216, and 219 to detect the temperature of the recording head 101, ink discharging heaters 222 and 225 to discharge ink, and sub-heaters 217 and 218 that heat the ink, and so forth, these being controlled by a recording head driver 310. The recording head driver 310 drives the ink discharging heaters 222 and 225 and sub-heaters 217 and 218, so as to perform discharging of ink and temperature-retention control of the recording head 101. The output values of the diode sensors are acquired at 10 msec cycles, the acquired values are converted into temperature, and stored in the RAM 305. A carriage motor 318 is a motor to move the carriage mounting the recording head 101, and is controlled by a carriage motor driver 311. A conveyance motor 319 is a motor for conveying the recording medium, and is controlled by a conveyance motor driver 312. A feeding motor 320 is a motor for picking up the recording medium from the loading unit, and is controlled by a feeding motor driver 313.

The host computer 321 includes a printer driver 322 that communicates with a recording apparatus handling recording information such as recording images, recording quality, recording medium size, recording medium type, recording face information, and so forth, in a case where executing of a recording operation is commanded by the user. The CPU 303 exchanges recording images and so forth with the host computer 321 via an interface unit 309. Note that the above-described components 303 through 313 are connected to each other via a system bus 302 that the CPU 303 manages.

One of the three recording modes of normal conveyance recording mode, double-side recording mode, and overlapped tandem feed recording mode, is selected, and recording is performed according to the selected recording mode. The aforementioned normal conveyance recording mode in the present embodiment is a recording mode where sheet feeding of a following recording medium is started for recording after discharge of a recording medium which has been recorded on earlier ends, and recording is performed on only one face of the recording medium.

Double-side recording mode is a recording mode where recording is performed on the front face of one recording medium, following which the conveyance motor 319 is rotated in reverse to retract the recording medium, the front and back of the sheet is flipped using an inversion mechanism (not illustrated), the conveyance motor 319 is then rotated forward to match the leading edge of the rear face, and recording is performed on the rear face of the recording medium as well. The amount of time for recording from the end of recording of the front face of the recording medium till the end of recording of the rear face in the double-side recording mode is shorter than the time for recording from the end of recording of one recording medium till the starting recording of the next recording medium in the normal conveyance recording mode.

The aforementioned overlapped tandem feed recording mode is a recording mode where recording is performed on only one face of the recording medium, with the amount of time from ending recording of the preceding recording medium till completion of feeding of the following recording medium being reduced. In the overlapped tandem feed recording mode, the amount of recording time from ending recording of the preceding recording medium till starting recording on the following recording medium can be reduced as compared to the normal conveyance recording mode. The overlapped tandem feed recording will now be described.

FIGS. 6A through 8C are diagrams for describing, in time sequence, the operations of the recording apparatus according to the present embodiment in the overlapped tandem feed recording mode. First, upon recording data being transmitted from the host computer 321 to the interface unit 309, the recording data is processed at the CPU 303, and then loaded to the RAM 305 as rasterized data. The CPU 303 starts recording operations based on the rasterized data.

Figure 6A:
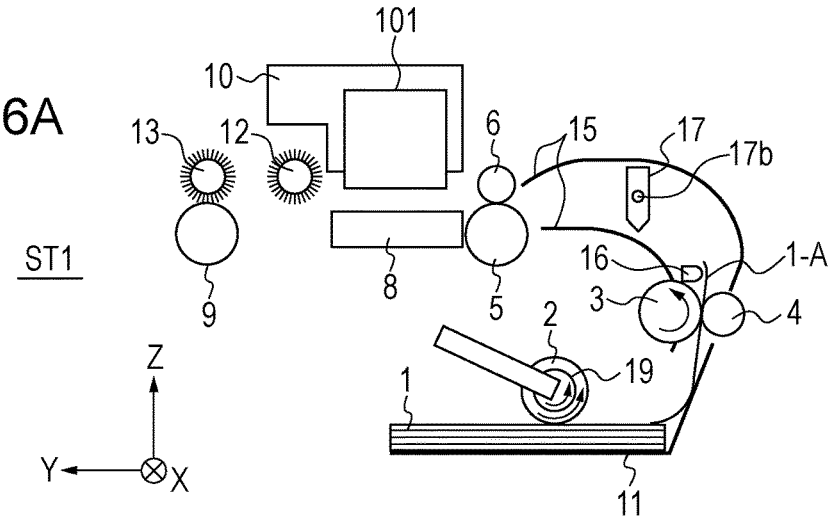
FIGS. 6A through 6C are diagrams for describing an overlapped tandem feed recording mode according to an embodiment.

In ST1 in FIG. 6A, first, the feeding motor 320 is driven at low speed by the feeding motor driver 313. The pickup roller 2 is rotated at 7.6 inches per second at this time. Upon the pickup roller 2 rotating, the topmost recording medium loaded on the feeding tray 11 (preceding recording medium 1-A) is picked up. The preceding recording medium 1-A picked up by the pickup roller 2 is conveyed by the feeding roller 3 rotating in the same direction as the pickup roller 2. The feeding roller 3 is also being driven by the feeding motor 320. Although the present embodiment is described by way of a configuration having the pickup roller 2 and the feeding roller 3, a configuration may be used which only has a feeding roller that feeds the recording medium loaded on the loading unit.

Upon the leading edge of the preceding recording medium 1-A being detected by the recording medium detecting sensor 16 disposed downstream of the feeding roller 3, the feeding motor 320 is then switched to high-speed driving. That is to say, the pickup roller 2 and feeding roller 3 are rotated at 20 inches per second.

Figure 6B:
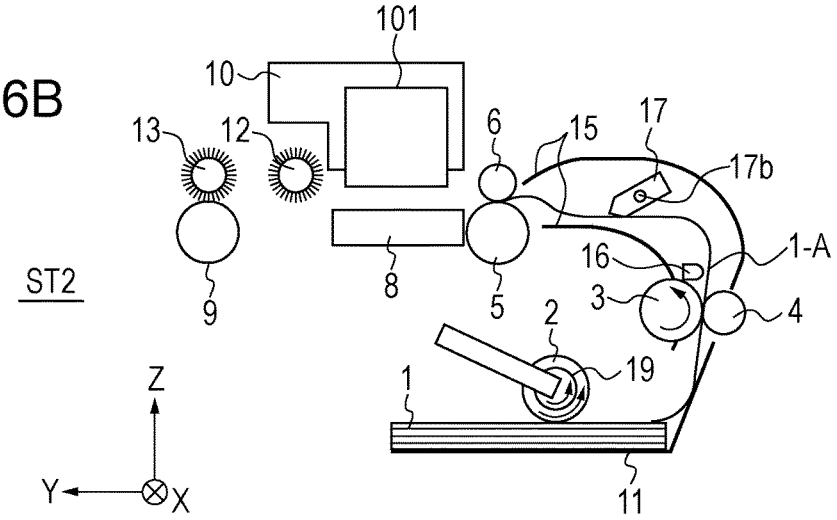

In ST2 in FIG. 6B, the leading edge of the preceding recording medium 1-A rotates the recording medium pressing lever 17 clockwise on the rotating shaft 17*b* against the biasing force of the spring, due to the feeding roller 3 being continuously rotated. Further rotating the feeding roller 3 causes the leading edge of the preceding recording medium 1-A to abut the conveyance nip formed at the conveyance roller 5 and pinch roller 6. The conveyance roller 5 is in a stopped state at this time. Rotating the feeding roller 3 by a predetermined amount after the leading edge of the preceding recording medium 1-A abuts the conveyance nip aligns the preceding recording medium 1-A with the leading edge abutting the conveyance nip, thereby rectifying skewing. This skewing rectification operation is also called a registration operation.

Figure 6C:
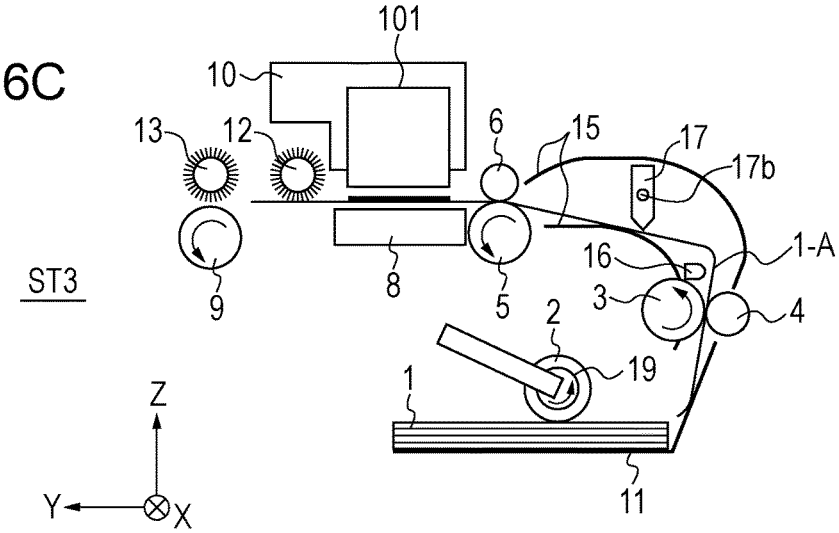

In the following ST3 in FIG. 6C, upon the skewing rectification operation of the preceding recording medium 1-A being completed, the conveyance motor 319 is driven, and the conveyance roller 5 starts rotating. The conveyance roller 5 conveys the recording medium at 15 inches per second. After the leading edge of the preceding recording medium 1-A is matched at a position facing the recording head 101, the recording operation is performed where ink is discharged onto the recording medium by the recording head 101, based on the recording data. Note that the leading edge matching operation is performed by the leading edge of the recording medium being abutted against the conveyance nip so as to be temporarily positioned at the position of the conveyance roller 5, and thereafter the amount of rotation of the conveyance roller 5 being controlled thereafter with the position of the conveyance roller 5 as a reference.

The recording apparatus according to the present embodiment is a serial type recording apparatus where the recording head 101 is mounted on the carriage 10. Recording operations on the recording medium are performed by repeating conveying operations where intermittent conveyance is performed in which the recording medium is moved in predetermined amounts, and image forming operations where the carriage 10 is moved while the conveyance roller 5 is stopped to discharge ink from the recording head 101.

Upon the leading edge of the preceding recording medium 1-A being matched, the feeding motor 320 is switched to low-speed driving. That is to say, the pickup roller 2 and the feeding roller 3 are rotated at 7.6 inches per second. The feeding roller 3 is also intermittently driven by the feeding motor 320 while the conveyance roller 5 is performing intermittent conveyance of the recording medium in predetermined amounts. That is to say, when the conveyance roller 5 is rotating, the feeding roller 3 also is rotating, and when the conveyance roller 5 is stopped, the feeding roller 3 also is stopped. The rotational speed of the feeding roller 3 is smaller than the rotational speed of the conveyance roller 5. Accordingly, the recording medium is kept taut between the conveyance roller 5 and the feeding roller 3. The feeding roller 3 follows the recording medium conveyed by the conveyance roller 5.

The feeding motor 320 is intermittently driven, so the driving shaft 19 is also driven. As described earlier, the rotational speed of the pickup roller 2 is slower than the rotational speed of the conveyance roller 5.

Accordingly, the pickup roller 2 follows the recording medium conveyed by the conveyance roller 5. That is to say, the pickup roller 2 rotates ahead of the driving shaft 19. Specifically, the protrusion 19*a* of the driving shaft 19 separates from the first face 2*a*, and is in a state of being in contact with the second face 2*b*. Accordingly, the second sheet of the recording medium (following recording medium 1-B) is not picked up immediately after the trailing edge of the preceding recording medium 1-A passes the pickup roller 2. After driving the driving shaft 19 a predetermined amount of time, the protrusion 19*a* comes into contact with the first face 2*a*, and the pickup roller 2 starts rotating.

Figure 7A:
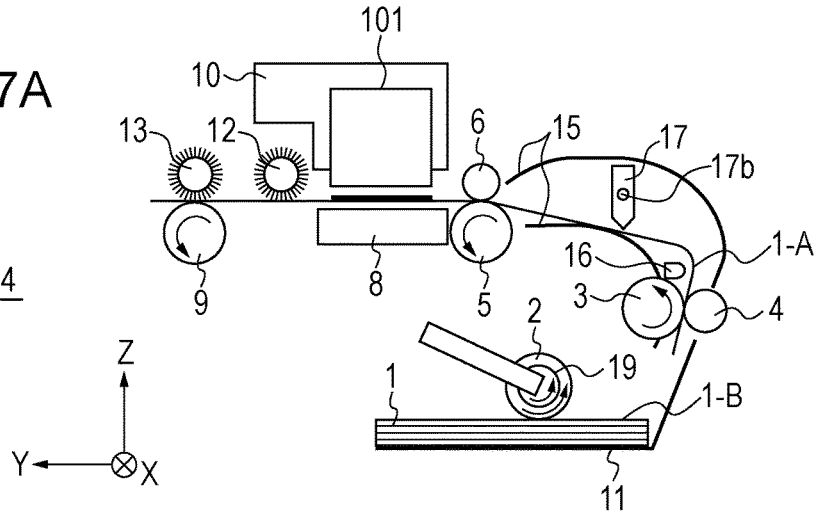
FIGS. 7A through 7C are diagrams for describing an overlapped tandem feed recording mode according to an embodiment.

ST4 in FIG. 7A illustrates a state where the pickup roller 2 has started rotating, and the following recording medium 1-B has been picked up. The recording medium detecting sensor 16 needs a predetermined amount or more of spacing between the recording mediums in order to detect the edges of the recording mediums, due to factors such as sensor responsiveness and so forth. That is to say, after the trailing edge of the preceding recording medium 1-A is detected by the recording medium detecting sensor 16, a predetermined time interval needs to be provided before detecting the following recording medium 1-B. The trailing edge of the preceding recording medium 1-A and the leading edge of the following recording medium 1-B need to be distanced by a predetermined distance to this end. This is why the recessed portion 2*c* of the pickup roller 2 is set to approximately 70 degrees.

Figure 7B:
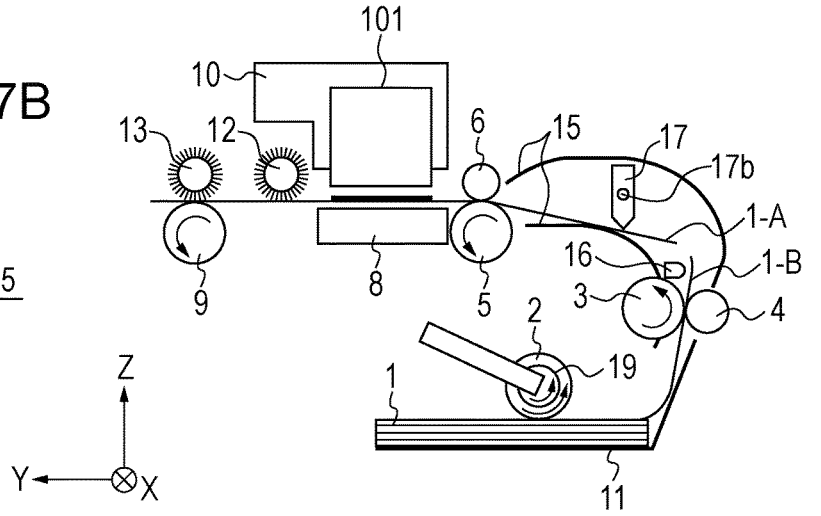

Next, in ST5 in FIG. 7B, the following recording medium 1-B picked up by the pickup roller 2 is conveyed by the feeding roller 3. At this time, the preceding recording medium 1-A is being subjected to the image forming operations by the recording head 101 based on the recording data. Upon the leading edge of the following recording medium 1-B being detected by the recording medium detecting sensor 16, the feeding motor 320 is switched to high speed driving. That is to say, the pickup roller 2 and feeding roller 3 are rotated at 20 inches per second.

Figure 7C:
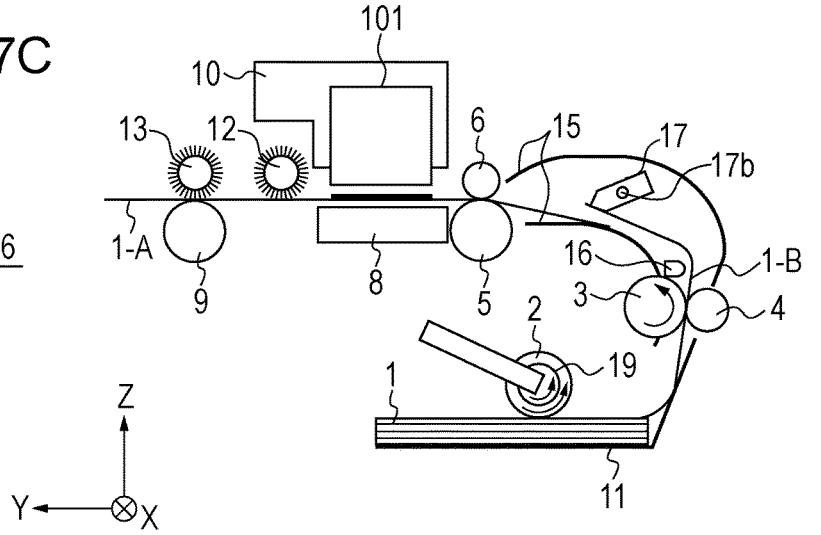

Next, in ST6 in FIG. 7C, the trailing edge of the preceding recording medium 1-A is pressed downwards by the recording medium pressing lever 17 as illustrated in ST5 in FIG. 4. Moving the following recording medium 1-B at a high speed as to the speed of the preceding recording medium 1-A moving downstream by the recording operations by the recording head 101 enables the state to be formed where the leading edge of the following recording medium 1-B overlaps the trailing edge of the preceding recording medium 1-A. The preceding recording medium 1-A is being subjected to recording operations based on the recording data, and accordingly the preceding recording medium 1-A is being intermittently conveyed by the conveyance roller 5. On the other hand, after the leading edge of the following recording medium 1-B is detected by the recording medium detecting sensor 16, the following recording medium 1-B can catch up to the preceding recording medium 1-A by the feeding roller 3 being consecutively rotated at 20 inches per second.

Figure 8A:
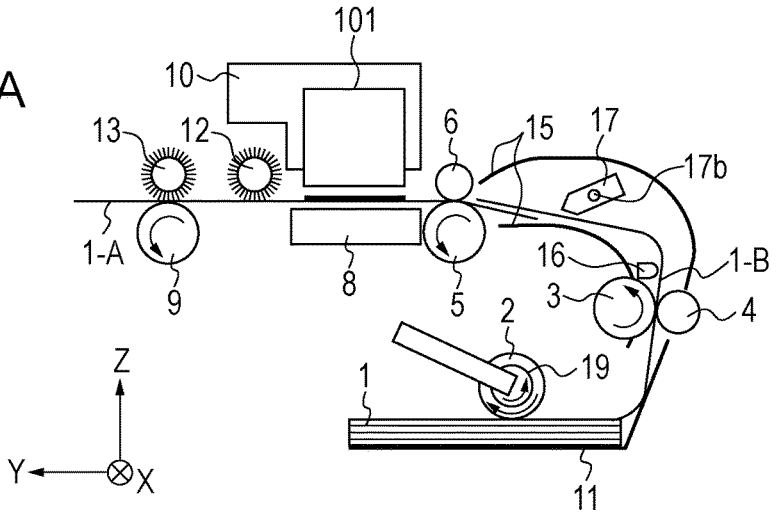
FIGS. 8A through 8C are diagrams for describing an overlapped tandem feed recording mode according to an embodiment.

In ST7 in FIG. 8A, a state where the leading edge of the following recording medium 1-B overlaps the trailing edge of the preceding recording medium 1-A is formed, and thereafter the following recording medium 1-B is conveyed by the feeding roller 3 to where the leading edge reaches a predetermined position upstream of the conveyance nip and stops. Note that the leading edge of the following recording medium 1-B does not have to come into contact with the trailing edge of the preceding recording medium 1-A. The position of the leading edge of the following recording medium 1-B is calculated from the amount of rotation of the feeding roller 3 after detection of the leading edge of the following recording medium 1-B by the recording medium detecting sensor 16, and control is performed based on these calculation results. Image forming operations are being performed at this time by the recording head 101 based on the recording data, with regard to the preceding recording medium 1-A.

Figure 8B:
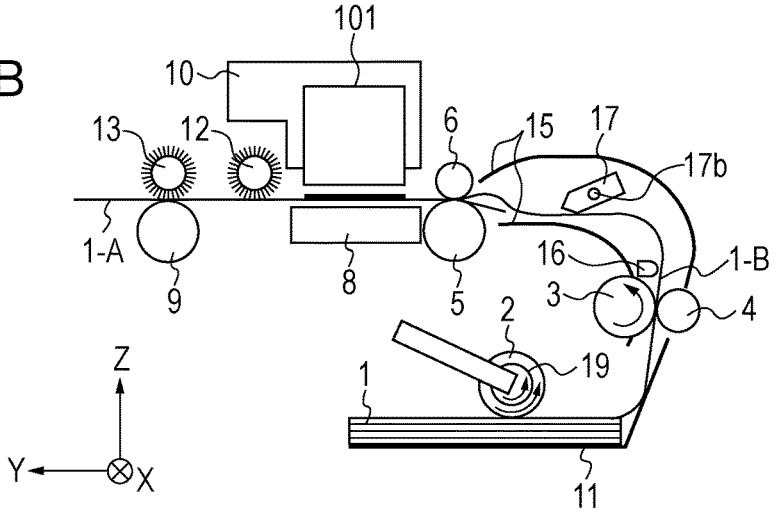

Next, in ST8 in FIG. 8B, while the conveyance roller 5 is stopped to perform the image forming operation (ink discharging operation) on the last row of the preceding recording medium 1-A, the feeding roller 3 is driven, thereby abutting the leading edge of the following recording medium 1-B against the conveyance nip, thus performing skewing rectification operations of the following recording medium 1-B.

Figure 8C:
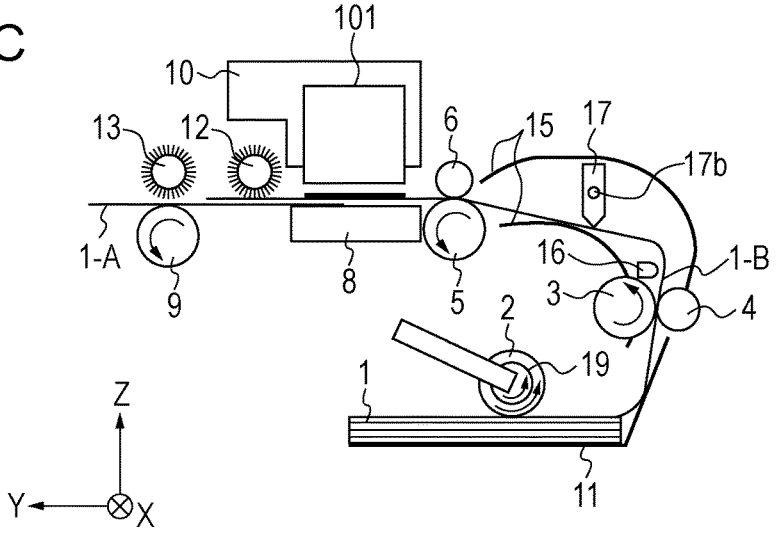

Upon the image forming operations of the last line of the preceding recording medium 1-A ending, in ST9 in FIG. 8C, the conveyance roller 5 is rotated a predetermined amount, whereby the leading edge of the following recording medium 1-B can be matched while maintaining the state in which the following recording medium 1-B is overlapping the preceding recording medium 1-A. Recording operations are performed by the recording head 101 on the following recording medium 1-B, based on the recording data. Intermittent conveyance of the following recording medium 1-B due to recording operations causes the preceding recording medium 1-A to be conveyed intermittently as well, and the preceding recording medium 1-A eventually is externally discharged from the recording apparatus by the discharge roller 9.

Upon the leading edge of the following recording medium 1-B being matched, the feeding motor 320 is switched to low-speed driving. That is to say, the pickup roller 2 and the feeding roller 3 are rotated at 7.6 inches per second. In a case where there is recording data after the following recording medium 1-B, the flow returns to ST4 in FIG. 7A, and pickup operations are performed for the third sheet.

Figure 9A:
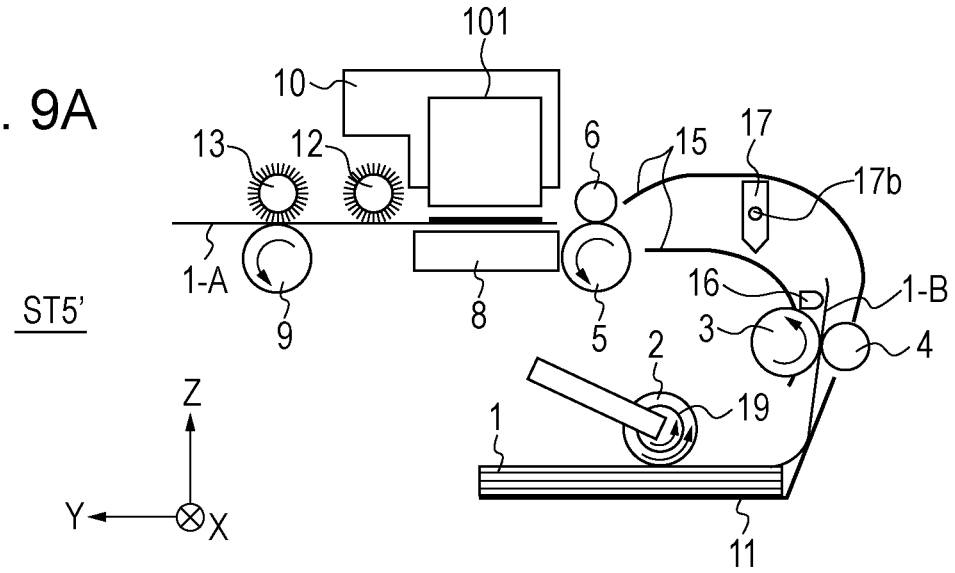
FIGS. 9A and 9B are diagrams for describing a normal conveyance recording mode according to an embodiment.
Figure 9B:
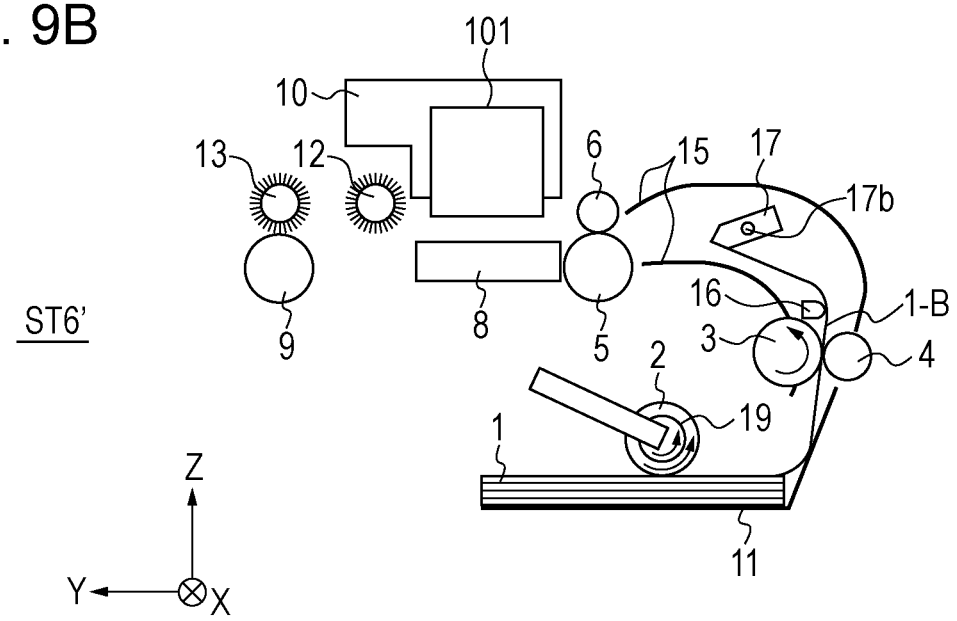

On the other hand, the normal conveyance mode uses almost the same control from ST1 through ST4 as the overlapped tandem feed recording mode. Note however, that as schematically illustrated in FIGS. 9A and 9B, the recording of the preceding recording medium 1-A has already ended at the time of picking up the following recording medium 1-B in ST5' following ST4, so the preceding recording medium 1-A and following recording medium 1-B never overlap. Further, as recording progresses and by the time that the following recording medium 1-B is conveyed to the position illustrated by ST6' in FIG. 9B, the preceding recording medium 1-A has already been discharged externally from the recording apparatus. Thereafter, the flow returns to ST4 in FIG. 7, and following recording of the second sheet having ended, the pickup of the third sheet is performed. While an arrangement has been described here where the following recording medium 1-B is picked up before the preceding recording medium 1-A is discharged externally from the recording apparatus, an arrangement may be made where the following recording medium 1-B is picked up after the preceding recording medium 1-A is discharged externally from the recording apparatus.

Figure 10:
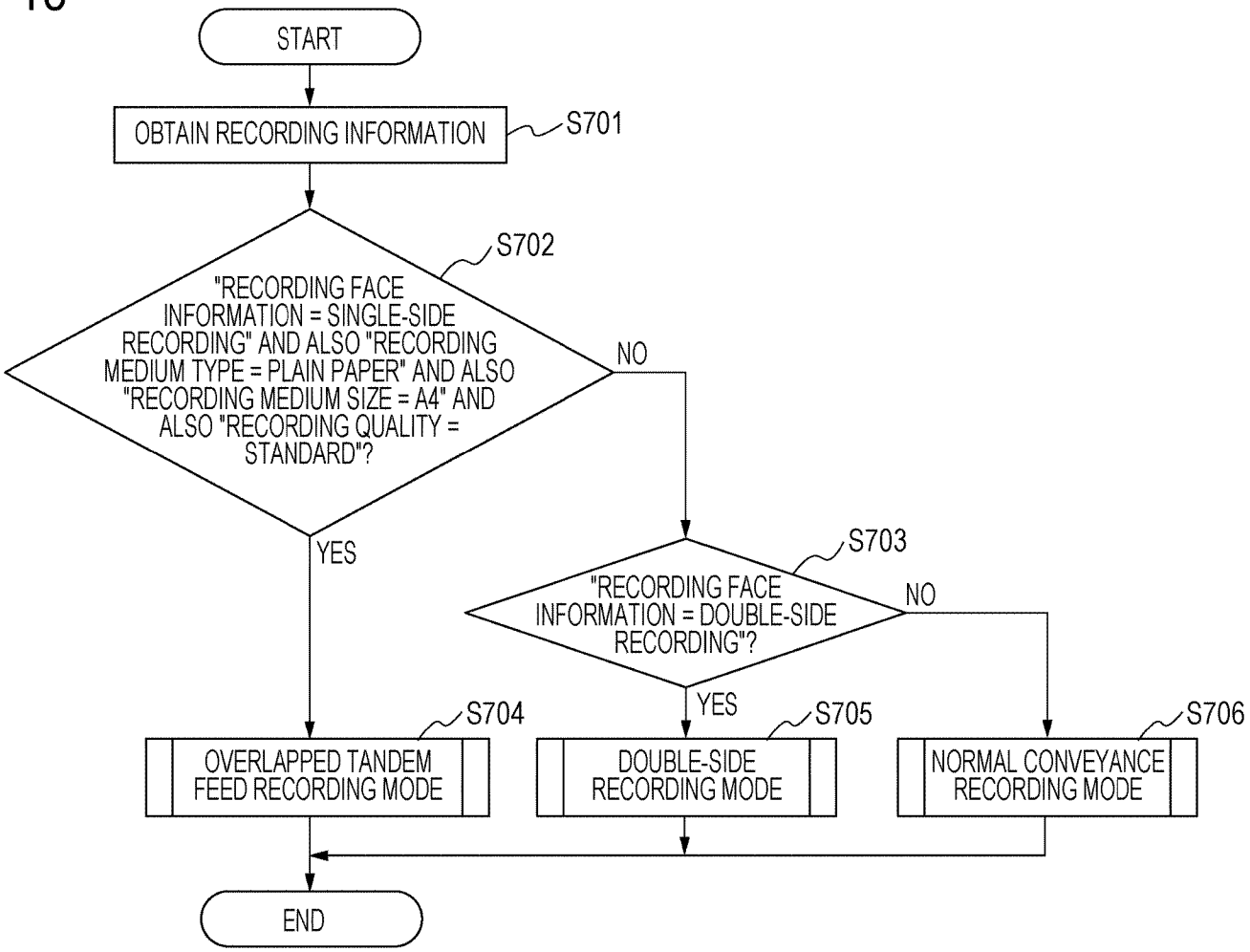
FIG. 10 is a flowchart illustrating a selection method of a recording mode according to an embodiment.

FIG. 10 is a flowchart illustrating a method for selecting the normal conveyance recording mode, the double-side recording mode, and the overlapped tandem feed recording mode. Upon a user command from the host computer 321 to perform a recording operation being executed, in step S701 the CPU 303 processes the recording information received from the host computer 321, and loads to the RAM 305 as rasterized data.

In step S702, the CPU 303 references recording conditions including in the recording information loaded to the RAM 305, such as recording face information, recording medium type, recording medium size, recording quality, and so forth. Only in a case where all four conditions of (1) the recording face information being single-side recording, (2) the recording medium type being plain paper, (3) the recording medium size being A4 size or letter size, and (4) the recording quality being standard (the number of scans as to a unit area on the recording medium is less than a predetermined number), are satisfied, does the flow advance to step S704, and a later-described sequence for the overlapped tandem feed recording mode is executed. Otherwise, which is to say in a case where even one of the conditions (1) through (4) is not met, the flow advances to step S703.

Thus, in a case where the size of the recording medium is small, and the trailing edge of the preceding recording medium and the leading edge of the following recording medium do not overlap as illustrated in ST6 in FIG. 7, the overlapped tandem feed recording mode is not selected in the present embodiment. Also, in a case where the recording quality is high quality or the recording medium type is glossy paper, i.e., in a case where recording quality is given priority over recording speed, the overlapped tandem feed recording is not selected.

In step S703, the CPU 303 determines whether or not the recording face information is double-side recording. If double-side recording, the flow advances to step S705, and a later-described sequence for the double-side recording mode is executed. If not double-side recording, the flow advances to step S706, and a later-described sequence for the normal conveyance recording mode is executed.

The determination conditions and the order in step S702 and step S703 are not restricted to those illustrated here. For example, if the recording apparatus has two feeding trays 11, one of the two feeding trays may be set to not execute overlapped tandem feeding in step S702. Also, the determination of whether double-side conveyance in step S703 may be made before the determination of whether or not to perform overlapped tandem feeding in step S702.

Figure 11:
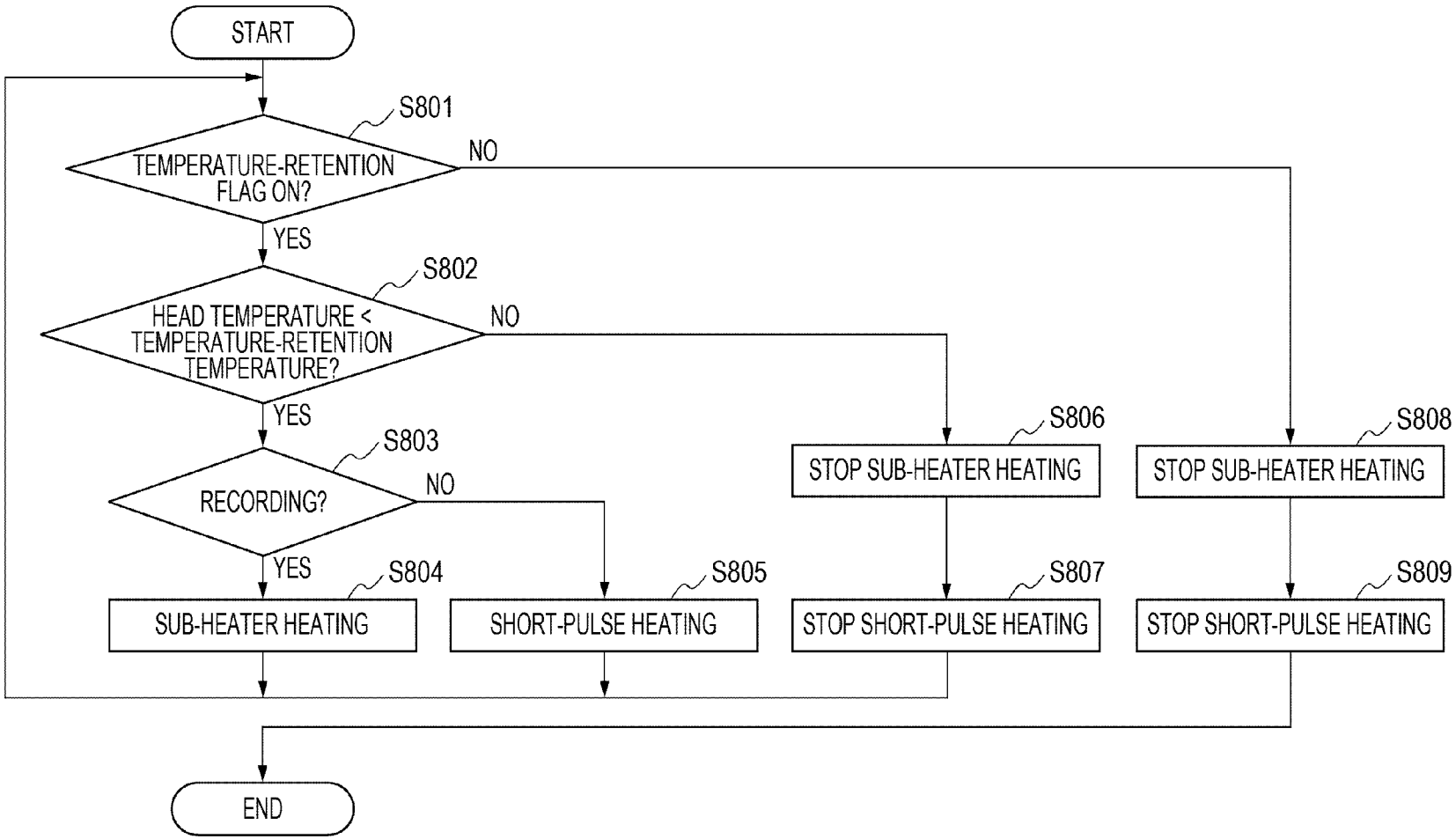
FIG. 11 is a flowchart illustrating a temperature-retention sequence according to an embodiment.

FIG. 11 is a flowchart illustrating a temperature-retention sequence of the recording head 101 according to the present embodiment. In step S801, the CPU 303 obtains temperature-retention flag information stored in the RAM 305, and determines whether or not the temperature-retention flag is on. In a case where the temperature-retention flag is on, the flow advances to step S802, and if the temperature-retention flag is off, the flow advances to step S808. The temperature-retention flag is a flag indicating whether or not to maintain the recording head at a predetermined temperature. The timing of switching the temperature-retention flag on and off will be described later.

In step S802, the CPU 303 compares the recording head temperature stored in the RAM 305 with the target temperature of the recording head stored in the ROM 304. The target temperature in the present embodiment is 50° C. In a case where the temperature of the recording head is lower than 50° C., the flow advances to step S803, and if 50° C. or higher, to step S806.

In step S803, the CPU 303 determines whether or not recording is being performed by the recording head. If recording is not being performed, the flow advances to step S805, where the above-described short-pulse heating is performed to heat the head. If recording is being performed, the ink discharging heaters 222 and 225 cannot be used for short-pulse heating since they are being used for recording, so the sub-heater 117 is driven to heat the head. After steps S804 and S805, the flow returns to step S801.

In a case where determination is made in step S801 that the temperature-retention flag is off, or in step S802 that the head temperature is 50° C. or higher, heating of the recording head is unnecessary. Accordingly, sub-heater heating and short-pulse heating is temporarily stopped in steps S806, S807, S808, and S809. After step S807, the flow returns to step S801. After step S809, the flow ends.

Figure 12:
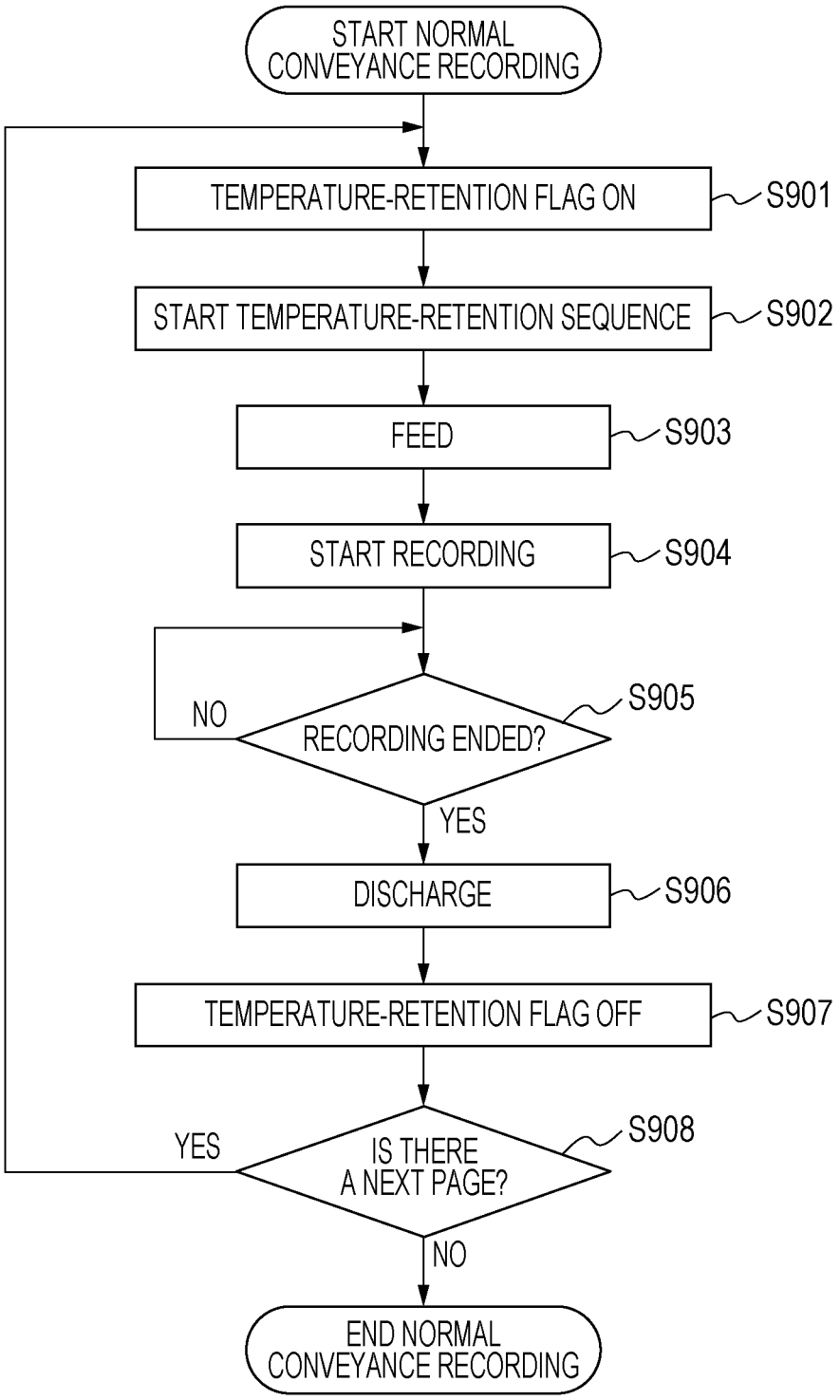
FIG. 12 is a flowchart illustrating a recording sequence in a normal conveyance recording mode.

The timing for switching the temperature-retention flag on and off in the above-described three recording modes will be described next with reference to FIGS. 12 through 14. FIG. 12 is a flowchart illustrating the recording sequence in the normal conveyance recording mode in step S706 in FIG. 10. Note that the normal conveyance recording mode is a conveyance method used in cases other than plain-paper single-side recording and double-side recording, as described with reference to FIG. 10, and is selected for recording on glossy paper, for example.

First, in step S901, the CPU 303 changes the temperature-retention flag information stored in the RAM 305 to on. In step S902, the temperature-retention sequence described in FIG. 11 is started. Note that the temperature-retention sequence illustrated in FIG. 11 can be executed in parallel with the recording sequence illustrated in FIG. 12. In step S903 the feeding motor driver 313 drives the feeding motor 320 to feed the recording medium. In step S904 recording on the recording medium is started, and the flow advances to step S905. In step S905 determination is made by the CPU 303 regarding whether or not recording onto the recording medium being recorded on has ended, based on the recording data. In a case where recording has not ended, the recording continues, and in a case where recording has ended, the flow advances to step S906. The recording medium is discharged in step S906, and the flow advances to step S907. In step S907 the CPU 303 changes the temperature-retention flag stored in the RAM 305 to off. Once the temperature-retention flag goes off in step S907, the temperature-retention sequence in the flow illustrated in FIG. 10, that is being performed in parallel with this flow, ends.

In step S908, the CPU 303 determines whether or not there is recording data for a next page, based on the recording information. In a case where determination is made that there is recording data for a next page, the flow returns to S901, and the same temperature-retaining sequence and recording sequence are executed for the next page recording medium. In a case where determination is made that there is no recording data for a next page, the recording sequence in the normal conveyance recording mode ends.

While description is made in the present embodiment that the temperature-retention flag is set to off after discharging the recording medium, the temperature-retention flag may be set to off at the point of having ended recording. That is to say, the order of step S906 and S907 may be reversed. Further, the temperature-retention flag may be set to off while ejecting the recording medium.

Also, while description is made in the present embodiment that the temperature-retention flag is set to on before starting feeding of the recording medium, the temperature-retention flag may be set to on immediately before starting recording. Moreover, the temperature-retention flag may be set to on while feeding the recording medium.

Figure 13:
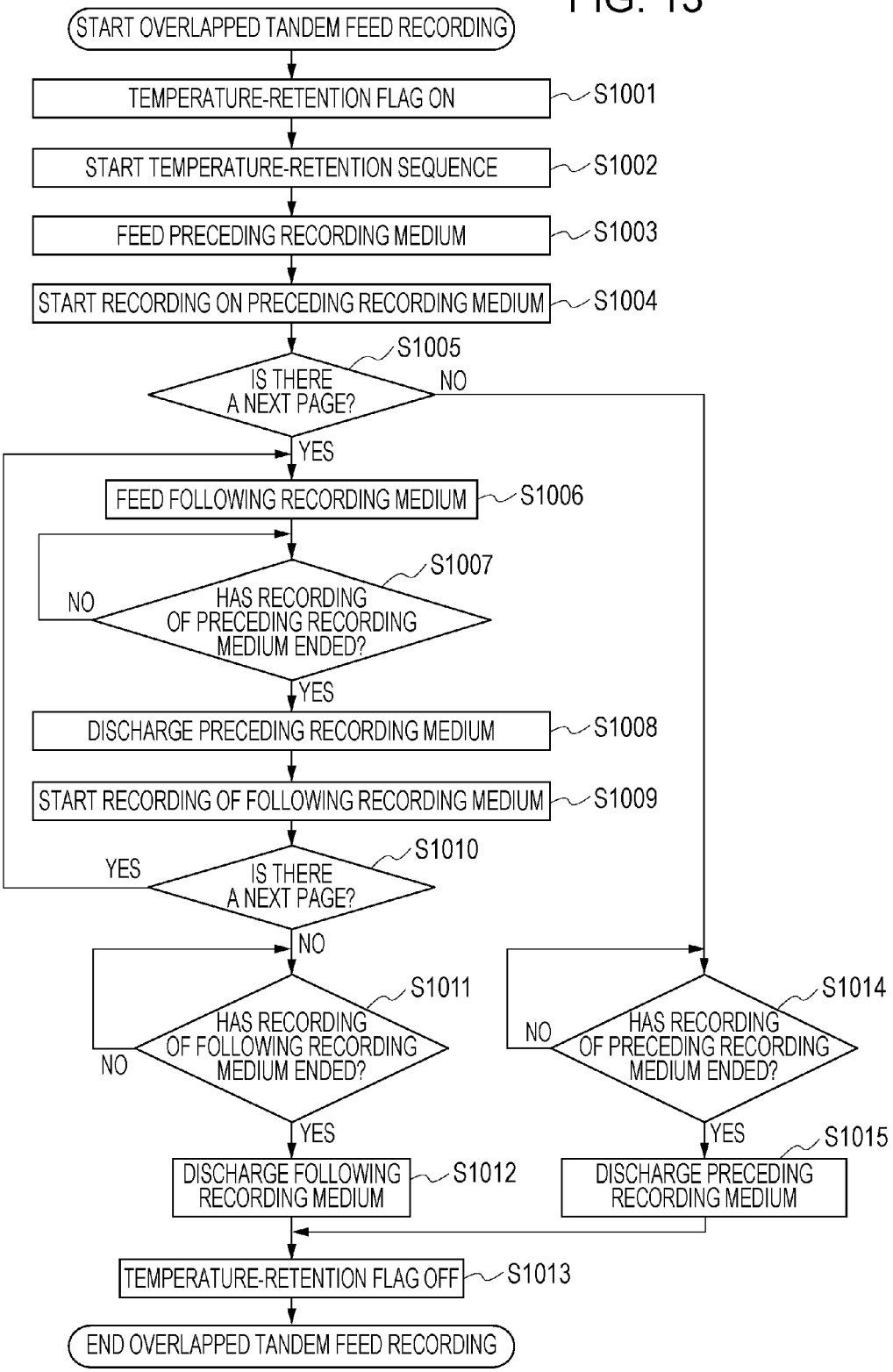
FIG. 13 is a flowchart illustrating a recording sequence in the overlapped tandem feed recording mode.

FIG. 13 is a flowchart illustrating the recording sequence in the overlapped tandem feed recording mode in step S704 in FIG. 10. Step S1001 and step S1002 are the same as step S901 and step S902 in FIG. 12. Note that the temperature-retention sequence illustrated in FIG. 11 can be executed in parallel with the recording sequence illustrated in FIG. 13. In step S1003, the recording medium to be recorded on first (preceding recording medium) is fed, and after sheet feeding, recording on the preceding recording medium is started in step S1004. The CPU 303 receives recording data from the host computer 321 even while recording, and determination of whether or not there is recording data of a next page is made by the CPU 303 in step S1005, based on the recording information. In a case where there is no recording data of the next page, the flow advances to step S1014. The CPU 303 makes determination in step S1004 regarding whether or not recording to the preceding recording medium has ended, and recording to the preceding recording medium is executed until ended. In a case where recording has ended, the flow advances to step S1015, and the preceding recording medium is discharged. Thereafter, the flow advances to step S1013, and the temperature-retention flag is set to off.

In a case where determination is made in step S1005 that there is recording data for a next page, the flow advances to step S1006. In step S1006, the recording medium to be recorded on next (following recording medium) is fed, and the flow advances to step S1007. The CPU 303 determines in step S1007 whether or not recording to the preceding recording medium has ended, and if recording has not ended the recording is continued until the recording is ended, and if ended the flow advances to step S1008. In step S1008 the preceding recording medium is discharged, and the flow advances to step S1009. Recording on the following recording medium is started in step S1009. Note that the detailed operations of step S1006 through step S1009 are the same as described above with reference to FIGS. 6 through 8.

In step S1010, the CPU 303 determines whether or not there is recording data for a next page, in the same way as in step S1005. In a case where there is recording data for the next page, the flow returns to step S1006, and executes the same recording sequence with the following recording medium regarding which recording was started in step S1009 as the preceding recording medium, and the recording medium on which recording is to be performed after the following recording medium regarding which recording was started in step S1009 as the following recording medium. In a case where there is no recording data for a next page, the flow advances to step S1011.

In step S1011, the CPU 303 determines whether or not recording to the following recording medium has ended, and if recording has not ended the recording is continued until the recording is ended, and if recording has ended the flow advances to step S1012. The following recording medium is discharged in step S1012, and the flow advances to step S1013. In step S1013, there is no data remaining to be recorded, so the CPU 303 changes the temperature-retention flag sored in the RAM 305 to off, and the flow ends. Setting the temperature-retention flag to off ends the temperature-retention sequence in FIG. 10 being executed in parallel with this flow.

While description is made in the present embodiment that the temperature-retention flag is set to off after discharging the recording medium, the temperature-retention flag may be set to off at the point of having ended recording. Alternatively, the temperature-retention flag may be set to off while ejecting the recording medium.

Figure 14:
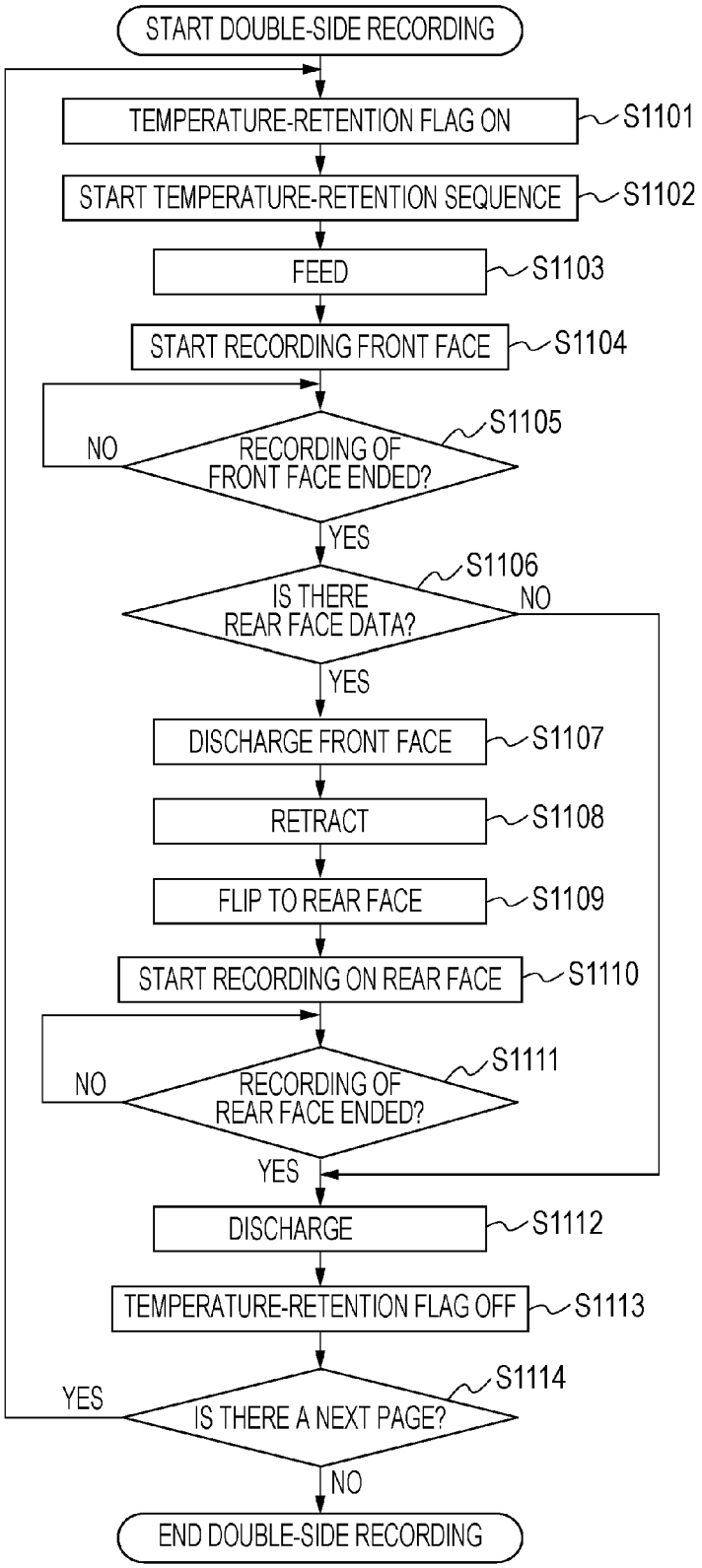
FIG. 14 is a flowchart illustrating a recording sequence in a double-side recording mode.

FIG. 14 is a flowchart illustrating the recording sequence in the normal conveyance recording mode in step S705 in FIG. 10. Step S1001 through step S1003 are the same as step S901 through step S903 in FIG. 12. Note that the temperature-retention sequence illustrated in FIG. 11 can be executed in parallel with the recording sequence illustrated in FIG. 14. In step S1104, recording on the front face of the recording medium is started. In step S1105 the CPU 303 determines whether or not recording to the front face of the recording medium has ended, and if recording has not ended the recording is continued until the recording is ended, and if ended the flow advances to step S1106.

In step S1106, whether or not there is recording data for the rear face of the recording medium is determined based on the recording information. In a case where there is recording data for the rear face, the flow advances to step S1107, and if not, to step S1112. In step S1107 the recording medium of which just the front face has been recorded is ejected, and the flow advances to step S1108. In step S1108, the conveyance motor driver 312 causes the conveyance motor 319 to be rotated in reverse to retract the recording medium, and the flow advances to step S1109. In step S1109, the front and back of the sheet is flipped using an inversion mechanism (not illustrated), and the flow advances to step S1110. In step S1110, recording is started on the rear face of the recording medium, and the flow advances to step S1111. The CPU 303 determines in step S1111 whether or not recording to the rear face of the recording medium has ended, and if recording has not ended the recording is continued until the recording is ended, and if ended the flow advances to step S1112. In step S1112, the recording medium is discharged, and the flow advances to step S1113. In step S1113, there is no data remaining to be recorded, so the CPU 303 changes the temperature-retention flag stored in the RAM 305 to off, and the flow ends. Setting the temperature-retention flag to off ends the temperature-retention sequence in FIG. 10 being executed in parallel with this flow.

In step S1114, the CPU 303 determines whether or not there is recording data for a next page, based on the recording information. In a case where determination is made that there is recording data for the next page, the flow returns to step S1101, and executes the same temperature-retention sequence and recording sequence on the next recording medium. That is to say, temperature-retention is not executed after ending recording to the rear face of the preceding recording medium till starting recording on the front face of the next recording medium. In a case where determination is made that there is no recording data for a next page, the recording sequence in the normal conveyance recording mode ends.

While description is made in the present embodiment that the temperature-retention flag is set to off after discharging the recording medium, the temperature-retention flag may be set to off at the point of having ended recording. That is to say, the order of step S1112 and S1113 may be reversed. Further, the temperature-retention flag may be set to off while ejecting the recording medium.

As described above, in the present embodiment, short-pulse heating and sub-heater heating are performed according to the temperature retention sequence illustrated in FIG. 11, by switching the temperature-retention flag on and off in accordance with the recording sequences illustrated in FIGS. 12 through 14 depending on the recording mode.

Figure 15A:
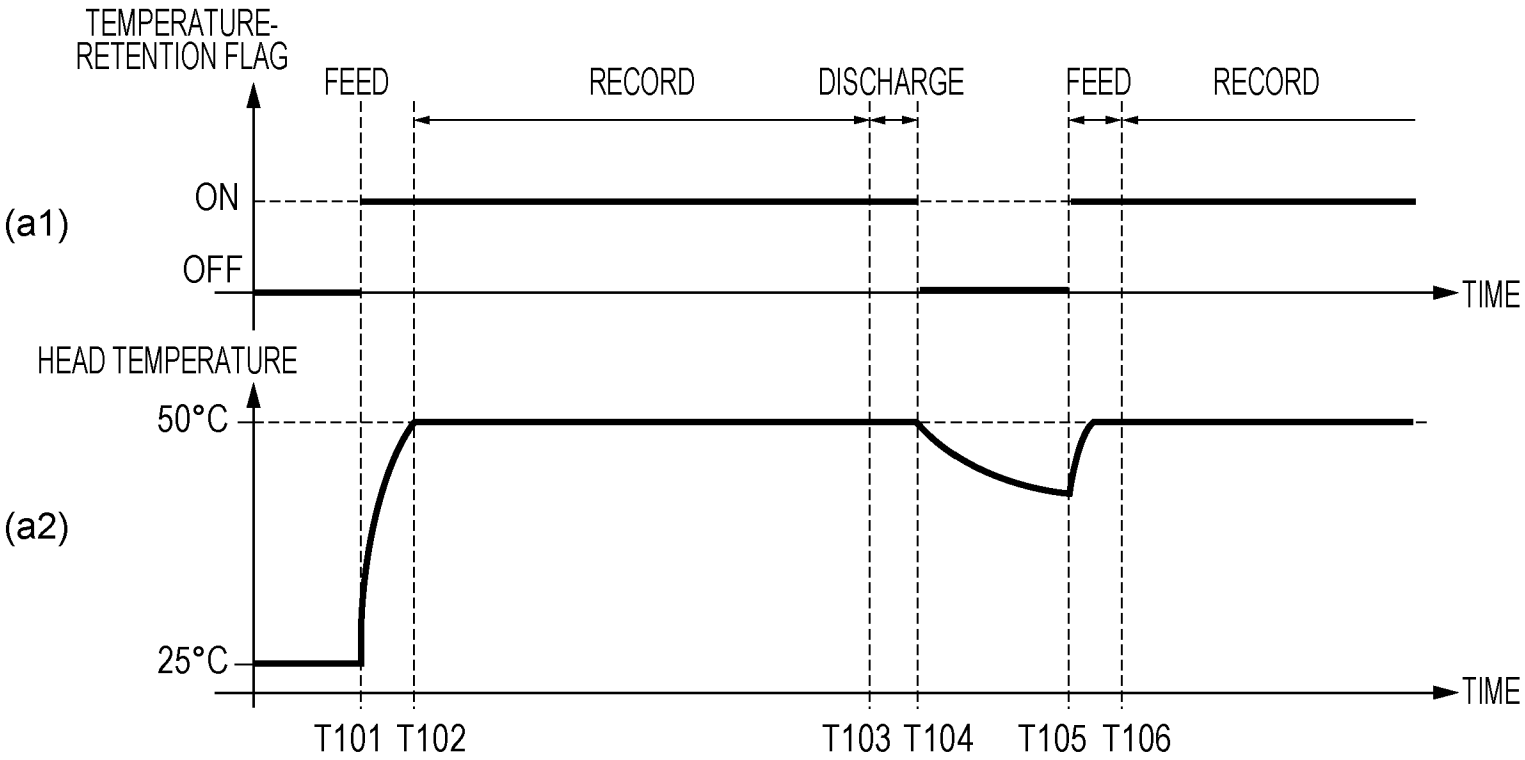
FIGS. 15A through 15C are diagrams for describing on/off switching of a temperature-retention flag and transition of temperature.
Figure 15B:
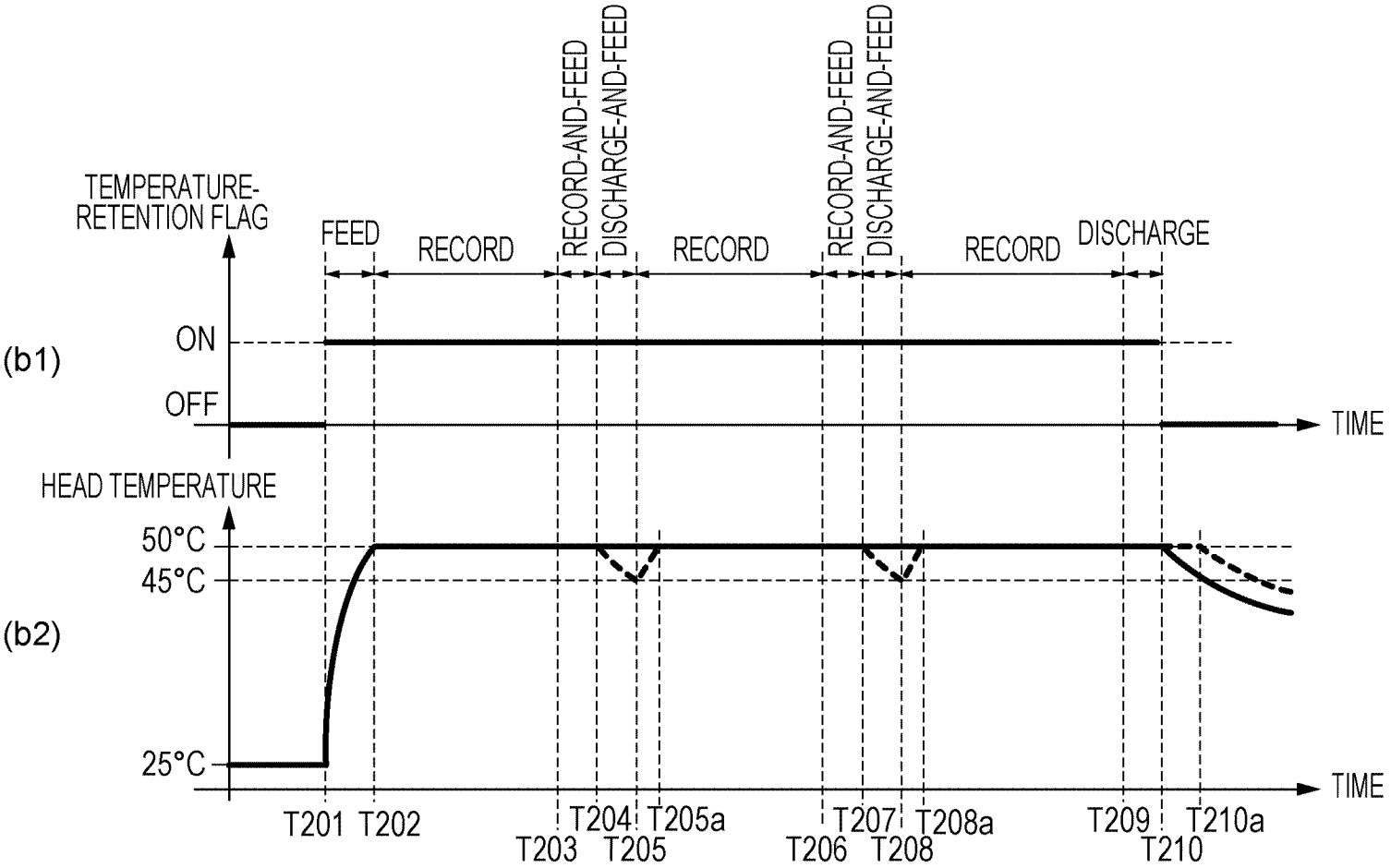
Figure 15C:
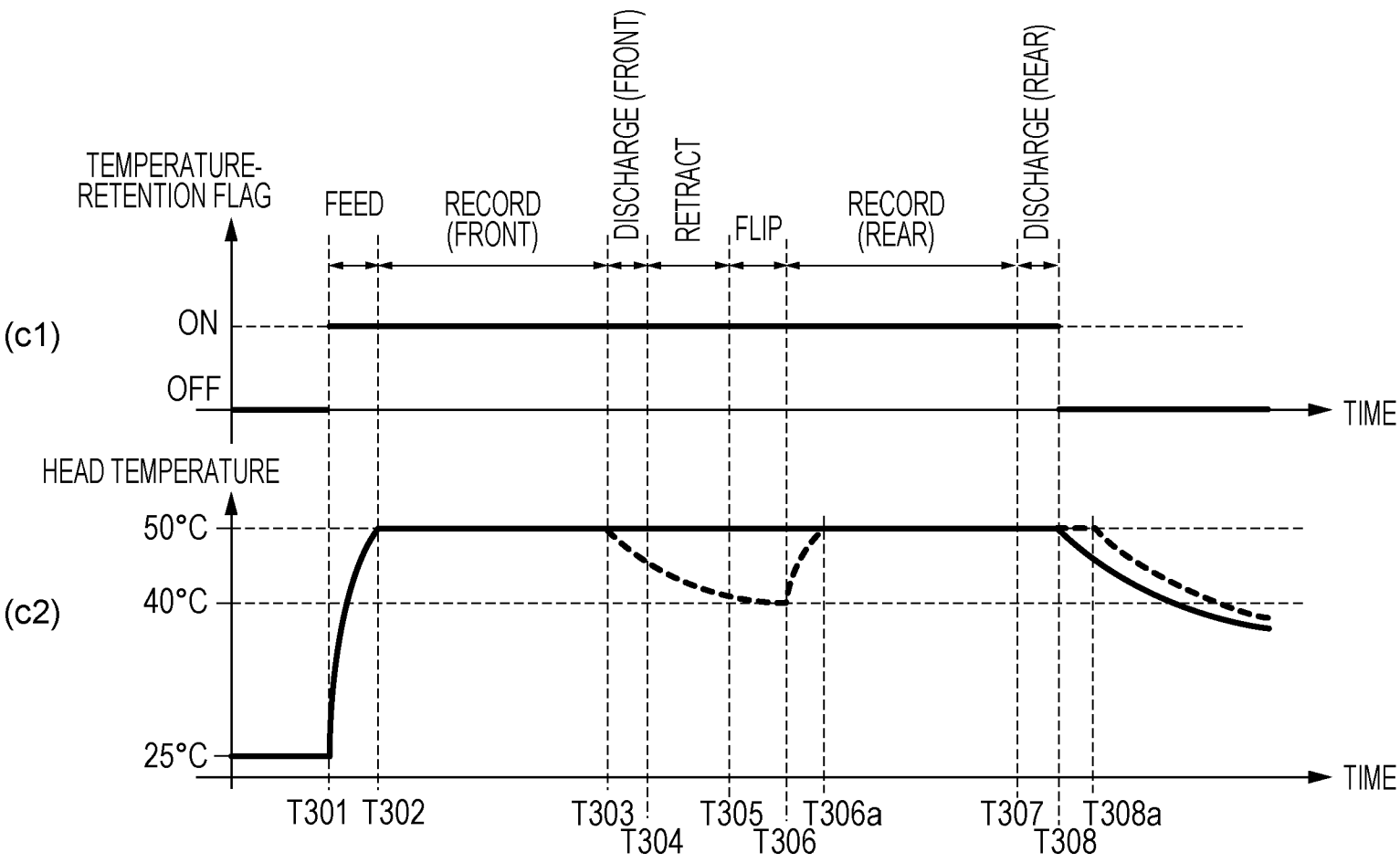

FIGS. 15A through 15C are diagrams for describing examples of recording head temperature transition in a time of executing heating following the recording sequences and temperature-retention sequence according to the present embodiment.

In FIG. 15A, (a1) indicates state transition of the on/off of the temperature-retention flag in the normal conveyance recording mode. Also, (a2) indicates an example of recording head temperature transition in a case of having switched the temperature-retention flag on and off as indicated by (a1). A case of consecutively recording on two sheets of recording medium will be described here.

Upon the recording apparatus 100 receiving recording data, heating of the recording head is performed at timing T101 to start sheet feeding. The recording head is heated to 50° C., which is the heating target temperature, by the time of completion of sheet feeding, and recording on the first sheet of the recording medium is started from the timing T102.

The recording medium is ejected after recording has ended on the first sheet of recording media at timing T103. At the timing T104 where ejection of the recording medium is complete, the temperature-retention flag is switched to off in step S1112 in the recording sequence in FIG. 12. The temperature-retention flag of the recording head is off from the timing T104 till the timing T105 at which the next sheet feed of recording medium is started, so the recording head is not heated during that time. Accordingly, the temperature of the recording head gradually drops over the period from the timing T104 to the timing T105. Also, there is no power consumption during the period from the timing T104 to the timing T105, since neither the ink discharging heaters 222 and 225 nor the sub-heaters 217 and 218 are driven.

In a case where the recording apparatus 100 has received recording data for the next page, the temperature-retention flag is set to on at timing T105 by step S901 in the recording sequence in FIG. 12, so the recording head is heated at the same time as sheet feeding is started.

Now, the sheet feeding time for sheet feeding of the second sheet of the recording medium in the normal conveyance recording mode (T106-T105) is two seconds, which is relatively longer than in the later-described overlapped tandem feed recording mode double-side recording mode, so the temperature of the recording head can be raised to 50° C. within the feeding time. Accordingly, even turning the temperature-retention flag off during the period after having ending ejecting of the first recording medium till starting feeding of the second recording medium does not cause heating waiting time to occur, and there is no deterioration in throughput. On the other hand, increase in power consumption during the period after having ending ejecting of the first recording medium till starting feeding of the second recording medium can be suppressed, as described earlier.

In FIG. 15B, (b1) indicates state transition of the on/off of the temperature-retention flag in the overlapped tandem feed recording mode. Also, (b2) indicates an example of recording head temperature transition in a case of having switched the temperature-retention flag on and off as indicated by (b1). A case of consecutively recording on three sheets of recording medium will be described here. In (b2), the solid line indicates the temperature transition in a case of having applied the present embodiment, while the dotted line indicates the temperature transition in a case of not applying the present embodiment.

In the overlapped tandem feed recording mode according to the present embodiment, the temperature-retention flag is set to on over a period during which ejecting of a recording medium which has been recorded first, and feeding on a following recording medium on which recording will be performed subsequently. Specifically, once the temperature-retention flag has been set to on in step S1001 in the recording sequence in FIG. 13, the temperature-retention flag is not switched on/off unless determination is made in step S1005 or S1010 that there is no recording data of the next page. Accordingly, the temperature does not drop even during the period between ejecting the recording medium on which recording was performed first and feeding of the recording medium on which recording will be performed subsequently, and the head temperature can be maintained at 50° C.

On the other hand, as indicated by the dotted line in (b2) in FIG. 15B, in a case where the temperature-retention flag is set to off during the period between ejecting of the recording medium on which recording was performed first (preceding recording medium) and feeding of the recording medium on which recording will be performed subsequently (following recording medium), i.e., the period (T205-T204), the heating is stopped at the timing T204 at which recording of one recording medium ends. Accordingly, the temperature of the recording head starts to drop from the timing T204. Here, the period (T205-T204) is 0.3 seconds which is relatively short, and printing cannot be started until the temperature of the recording head reaches 50° C., so heating is started from the timing T205 before recording on the following recording medium, and recording is started after the temperature reaches 50° C. at a timing T205*a*. Accordingly, the period (T205*a*-T205) is a heating waiting time of the recording head, so throughput suffers. This heating waiting time occurs for every sheet, so the loss in throughput at the time of ending recording on three sheets of recording medium is equivalent (T210*a*-T210) as compared to the present embodiment.

Thus, in the overlapped tandem feed recording mode according to the present embodiment, the temperature-retention flag is set to on over the period during which recording of the preceding recording medium has ended, and recording on the following recording medium starts, so heating is performed continuously. This enables recording to be performed with deterioration in throughput suppressed.

In FIG. 15C, (c1) indicates state transition of the on/off of the temperature-retention flag in the double-side recording mode. Also, (c2) indicates an example of recording head temperature transition in a case of having switched the temperature-retention flag on and off as indicated by (c1). A case of consecutively recording on the front face and rear face of one sheet of recording medium will be described here. In (c2), the solid line indicates the temperature transition in a case of having applied the present embodiment, while the dotted line indicates the temperature transition in a case of not applying the present embodiment.

In the double-side recording mode according to the present embodiment, the temperature-retention flag is set to on during the period from ending recording on the front face till starting recording on the rear face (T306-T303). Specifically, if there is rear face recording data, once the temperature-retention flag has been set to on in step S1001 in the recording sequence in FIG. 14, the temperature-retention flag is not switched on/off unless determination is made in step S1105 that recording to the front face has ended and further in step S1111 that recording of the rear face has ended. Accordingly, the temperature does not drop even during the period where the recording medium is being ejected (S1107), retracted (S1108), and reverted (S1109), and the head temperature can be maintained at 50° C.

On the other hand, as indicated by the dotted line in (c2) in FIG. 15C, in a case where the temperature-retention flag is set to off during the period between the timing T303 of ending the recording on the front face and the timing T306 of starting recording on the rear face, the heating is stopped at the timing T303 at which recording of front face ends, and the temperature of the recording head starts to drop. Here, recording cannot be started until the temperature of the recording head reaches 50° C., so heating is started from the timing T306 before recording on the rear face, and recording is started after the temperature reaches 50° C. at a timing T306*a*. Accordingly, the period (T306*a*-T306) is a heating waiting time of the recording head, the loss in throughput at the time of ending recording on both faces if one sheet of recording medium is equivalent (T308*a*-T308) as compared to the present embodiment.

Thus, in the double-side recording mode according to the present embodiment, the temperature-retention flag is set to on over the period during which recording of the front face has ended, and recording on the rear face starts, so heating is performed continuously. This enables recording to be performed with deterioration in throughput suppressed.

According to the present embodiment, different temperature-retention control is performed depending on the recording mode, as described above. Specifically, in the normal conveyance recording mode where there is a relatively long time from ending of recording onto one recording medium to starting recording on the next recording medium, the temperature-retention flag is switched to off between recordings. On the other hand, in the overlapped tandem feed recording mode where the time from ending of recording onto one recording medium to starting recording on the next recording medium is relatively short, and in the double-side recording mode where time from ending of recording on the front face to starting recording on the rear face is relatively short, the temperature-retention flag is switched maintained on even between recordings. Accordingly, recording with suppressed deterioration in throughput can be performed while suppressing unnecessary increase in power consumption.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Although an embodiment has been described above where short-pulse heating control is performed in periods where recording is not being performed, other embodiments may be made. For example, an arrangement may be made where heating is performed by sub-heater heating control in periods where recording is not being performed.

Although an embodiment has been described above where the temperature-retention flag is set to off in the double-side recording mode from ending of recording to the rear face of one recording medium till starting of recording on the front face of the next recording medium, so as to stop heating during this period, other embodiments may be made. For example, an arrangement may be made where the temperature-retention flag is set to on in a case where the period from ending of recording to the rear face of one recording medium till starting of recording on the front face of the next recording medium is short.

Thus, the inkjet recording apparatus, inkjet recording method, and program of the present invention can provide temperature-retention control that realizes both suppressed deterioration in throughput of recording and suppressed power consumption.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-167558, filed Aug. 20, 2014, which is hereby incorporated by reference herein in its entirety.

What is claimed is:

1. An ink jet recording apparatus, comprising:

a recording head configured to discharge ink;

an acquisition unit configured to acquire information relating to temperature of the recording head;

a conveying unit configured to convey a recording medium;

a mode selecting controller which performs selecting of one recording mode from a plurality of recording modes at least including (i) a first continuous recording mode where a first recording medium and a second recording medium are conveyed by the conveying unit such that, during recording of the first recording medium which is recorded upon first, the first recording medium and the second recording medium which is recorded upon next after the first recording medium do not overlap, and (ii) a second continuous recording mode where the first recording medium and the second recording medium are conveyed by the conveying unit such that, during recording of the first recording medium, an edge of the first recording medium at an upstream side in a conveyance direction and an edge of the second recording medium at a downstream side in the conveyance direction are overlapped;

a heating controller which performs heating of the recording head based on the information relating to the temperature of the recording head, wherein the heating controller executes (i) temporarily stopping of heating of the recording head during a period from ending of recording onto the first recording medium to starting of recording on the second recording medium in the first continuous recording mode, and (ii) heating of the recording head during the period from ending of recording onto the first recording medium to starting of recording on the second recording medium in the second continuous recording mode; and a recording controller which performs recording by the recording head in accordance with the selected recording mode.

2. The ink jet recording apparatus according to claim 1, wherein the heating controller performs heating, in the second continuous recording mode, so as not to heat the recording head when the temperature of the recording head is a first temperature, and so as to heat the recording head when the temperature of the recording head is a second temperature that is lower than the first temperature.

3. The ink jet recording apparatus according to claim 1, wherein the heating controller performs heating, in the first continuous recording mode, so as not to heat the recording head regardless of the temperature of the recording head.

4. The ink jet recording apparatus according to claim 1, wherein the mode selecting controller performs selecting of the first continuous recording mode in a case where a type of recording medium on which recording is to be performed is not plain paper.

5. The ink jet recording apparatus according to claim 1, wherein the mode selecting controller performs selecting of the first continuous recording mode in a case where a size of recording medium on which recording is to be performed is not A4 size or letter size.

6. The ink jet recording apparatus according to claim 1, wherein the mode selecting controller performs selecting of (i) the first continuous recording mode in a case where a number of scans of the recording head for recording a unit area on the recording medium is larger than a predetermined number, and (ii) either one of the first and second continuous recording modes in accordance with other recording conditions in a case where the number of scans is smaller than the predetermined number.

7. The ink jet recording apparatus according to claim 1, wherein the recording head includes at least a plurality of recording elements that emit heat energy used for discharging of ink, and a plurality of discharge orifices corresponding to the plurality of recording elements, and wherein the heating controller performs heating of the recording head by applying, to the plurality of recording elements, driving pulses for driving the recording elements, at a level that does not cause ink to be discharged.

8. An ink jet recording method of recording an image using a recording head configured to discharge ink, the method comprising;

acquiring information relating to temperature of the recording head;

conveying a recording medium;

performing heating control to heat the recording head so that the temperature of the recording head is a target temperature, based on the information relating to the temperature of the recording head acquired in the acquiring;

selecting one recording mode to execute, from a plurality of recording modes including at least a first recording mode where a first recording medium and a second recording medium are conveyed in the conveying such that, during recording of the first recording medium which is recorded upon first, the first recording medium and the second recording medium which is recorded upon next after the first recording medium do not overlap, a second recording mode where the first recording medium and the second recording medium are conveyed in the conveying such that, during recording of the first recording medium, an edge of the first recording medium at an upstream side in a conveyance direction and an edge of the second recording medium at a downstream side in the conveyance direction are overlapped; and recording by the recording head in accordance with recording mode selected in the selecting;

wherein, in the heating control, (i) heating of the recording head is temporarily stopped during a period from ending of recording onto the first recording medium till starting of recording on the second recording medium in a case of the first recording mode having been selected in the selecting, and (ii) the recording head is heated so as to maintain the target temperature, during the period from ending of recording onto the first recording medium till starting of recording on the second recording medium, in a case of the second recording mode having been selected in the selecting.

* * * * *